US008440965B2

(12) United States Patent
Musselman

(10) Patent No.: US 8,440,965 B2
(45) Date of Patent: May 14, 2013

(54) SAMPLING SYSTEM FOR USE WITH SURFACE IONIZATION SPECTROSCOPY

(75) Inventor: Brian Musselman, Melrose, MA (US)

(73) Assignee: Ionsense, Inc., Saugus, MA (US)

( * ) Notice: Subject to any disclaimer, the term of this patent is extended or adjusted under 35 U.S.C. 154(b) by 111 days.

(21) Appl. No.: 12/979,729

(22) Filed: Dec. 28, 2010

(65) Prior Publication Data

US 2011/0101216 A1 May 5, 2011

Related U.S. Application Data

(62) Division of application No. 11/872,666, filed on Oct. 15, 2007, now Pat. No. 7,928, 364.

(60) Provisional application No. 60/851,688, filed on Oct. 13, 2006.

(51) Int. Cl.
*H01J 49/04* (2006.01)

(52) U.S. Cl.
USPC ..... 250/285; 250/282; 250/288

(58) Field of Classification Search ..... 250/285
See application file for complete search history.

(56) References Cited

U.S. PATENT DOCUMENTS

| | | | |
|---|---|---|---|
| 3,633,027 | A | 1/1972 | Ryhage |
| 3,957,470 | A | 5/1976 | Dawes |
| 4,016,421 | A | 4/1977 | Hull |
| 4,213,326 | A | 7/1980 | Brodasky |
| 4,542,293 | A | 9/1985 | Fenn |
| 4,546,253 | A | 10/1985 | Tsuchiya |
| 4,654,052 | A | 3/1987 | Sharp |
| 4,861,988 | A | 8/1989 | Henion |
| 5,012,052 | A | 4/1991 | Hayes |
| 5,055,677 | A | 10/1991 | Amirav |
| 5,137,553 | A | 8/1992 | Dawes |

(Continued)

FOREIGN PATENT DOCUMENTS

| | | |
|---|---|---|
| GB | 2263578 | 7/1993 |
| WO | WO03025973 | 3/2003 |

(Continued)

OTHER PUBLICATIONS

Barber, M. et al., "Fast atom bombardment of solids (F.A.B.): a new ion source for mass spectrometry" J.Chem. Soc. Chem. Commun., 1981, 325.

(Continued)

*Primary Examiner* — Phillip A Johnston
(74) *Attorney, Agent, or Firm* — Sci-Law Strategies, PC

(57) ABSTRACT

The invention provides for efficient collection of analyte ions and neutral molecules from surfaces for their subsequent analysis with spectrometry. In an embodiment of the invention, a 'multiple desorption ionization source' includes a tube which can contain ions for subsequent sampling within a defined spatial resolution from desorption ionization at or near atmospheric pressures. In an embodiment, electrostatic fields are used to direct ions a plurality of tubes positioned in close proximity to the surface of the sample being analyzed. In an embodiment of the present invention, either narrow inside diameter capillary tubes or wide diameter tubes can be used in combination with a vacuum inlet to draw ions and neutrals into the spectrometer for analysis. In an embodiment of the invention, a dopant is introduced into a tube to analyze the sample. In an embodiment of the invention, a plurality of ionization sources is used to analyze the sample.

19 Claims, 25 Drawing Sheets

U.S. PATENT DOCUMENTS

| | | | | |
|---|---|---|---|---|
| 5,192,865 | A | 3/1993 | Zhu | |
| 5,306,412 | A | 4/1994 | Whitehouse | |
| 5,352,892 | A | 10/1994 | Mordehai | |
| 5,367,163 | A | 11/1994 | Otsuka | |
| 5,381,008 | A | 1/1995 | Tanner | |
| 5,412,208 | A | 5/1995 | Covey | |
| 5,448,062 | A | 9/1995 | Cooks | |
| 5,552,599 | A | 9/1996 | Giessmann | |
| 5,559,326 | A | 9/1996 | Goodley | |
| 5,614,711 | A | 3/1997 | Li | |
| 5,624,537 | A | 4/1997 | Turner | |
| 5,684,300 | A | 11/1997 | Taylor | |
| 5,736,741 | A | 4/1998 | Bertsch | |
| 5,788,166 | A | 8/1998 | Valaskovic | |
| 5,868,322 | A | 2/1999 | Loucks, Jr. | |
| 5,959,297 | A | 9/1999 | Weinberg | |
| 5,997,746 | A | 12/1999 | Valaskovic | |
| 6,107,628 | A | 8/2000 | Smith | |
| 6,124,675 | A | 9/2000 | Betrand | |
| 6,190,559 | B1 | 2/2001 | Valaskovic | |
| 6,225,623 | B1 | 5/2001 | Turner | |
| 6,359,275 | B1 | 3/2002 | Bertsch | |
| 6,395,183 | B1 | 5/2002 | Valaskovic | |
| 6,562,211 | B1 | 5/2003 | Kunnecke | |
| 6,583,408 | B2 | 6/2003 | Smith | |
| 6,600,155 | B1 | 7/2003 | Andrien, Jr. | |
| 6,646,256 | B2 | 11/2003 | Gourley | |
| 6,649,907 | B2 | 11/2003 | Ebeling | |
| 6,670,608 | B1 | 12/2003 | Taylor | |
| 6,677,593 | B1 * | 1/2004 | Van Berkel | 250/423 R |
| 6,690,006 | B2 | 2/2004 | Valaskovic | |
| 6,717,139 | B2 | 4/2004 | Taniguchi | |
| 6,723,985 | B2 | 4/2004 | Schultz | |
| 6,744,041 | B2 | 6/2004 | Sheehan | |
| 6,744,046 | B2 | 6/2004 | Valaskovic | |
| 6,784,424 | B1 | 8/2004 | Willoughby | |
| 6,803,565 | B2 | 10/2004 | Smith | |
| 6,806,468 | B2 | 10/2004 | Laiko | |
| 6,818,889 | B1 | 11/2004 | Sheehan | |
| 6,861,647 | B2 | 3/2005 | Reilly | |
| 6,878,930 | B1 | 4/2005 | Willoughby | |
| 6,888,132 | B1 | 5/2005 | Sheehan | |
| 6,914,243 | B2 | 7/2005 | Sheehan | |
| 6,943,347 | B1 | 9/2005 | Willoughby | |
| 6,949,739 | B2 | 9/2005 | Franzen | |
| 6,949,740 | B1 | 9/2005 | Sheehan | |
| 6,949,741 | B2 | 9/2005 | Cody | |
| 6,956,205 | B2 | 10/2005 | Park | |
| 6,977,372 | B2 | 12/2005 | Valaskovic | |
| 6,979,816 | B2 * | 12/2005 | Tang et al. | 250/288 |
| 6,992,299 | B2 | 1/2006 | Lee | |
| 7,015,466 | B2 | 3/2006 | Takats | |
| 7,064,317 | B2 | 6/2006 | McCluckey | |
| 7,081,618 | B2 | 7/2006 | Laprade | |
| 7,081,621 | B1 | 7/2006 | Willoughby | |
| 7,095,019 | B1 | 8/2006 | Sheehan | |
| 7,112,785 | B2 | 9/2006 | Laramee | |
| 7,138,626 | B1 | 11/2006 | Karpetsky | |
| 7,161,145 | B2 | 1/2007 | Oser | |
| 7,196,525 | B2 | 3/2007 | Sparkman | |
| 7,253,406 | B1 | 8/2007 | Sheehan | |
| 7,423,261 | B2 | 9/2008 | Truche et al. | |
| 7,429,731 | B1 | 9/2008 | Karpetsky | |
| 7,569,812 | B1 * | 8/2009 | Karpetsky et al. | 250/282 |
| 7,700,913 | B2 | 4/2010 | Musselman | |
| 7,705,297 | B2 | 4/2010 | Musselman | |
| 7,714,281 | B2 | 5/2010 | Musselman | |
| 7,777,181 | B2 | 8/2010 | Musselman | |
| 2002/0005478 | A1 | 1/2002 | Hillenkamp | |
| 2002/0121596 | A1 | 9/2002 | Laiko | |
| 2002/0121598 | A1 * | 9/2002 | Park | 250/288 |
| 2002/0185593 | A1 | 12/2002 | Doring | |
| 2002/0185595 | A1 | 12/2002 | Smith | |
| 2002/0185606 | A1 | 12/2002 | Smith | |
| 2003/0052268 | A1 | 3/2003 | Doroshenko | |
| 2004/0094706 | A1 | 5/2004 | Covey | |
| 2004/0129876 | A1 | 7/2004 | Franzen | |
| 2004/0159784 | A1 | 8/2004 | Doroshenko | |
| 2005/0029442 | A1 | 2/2005 | Takats | |
| 2005/0079631 | A1 | 4/2005 | Laiko | |
| 2005/0230635 | A1 | 10/2005 | Takats | |
| 2005/0236565 | A1 | 10/2005 | Oser | |
| 2006/0071665 | A1 | 4/2006 | Blake | |
| 2006/0079002 | A1 | 4/2006 | Gologan | |
| 2006/0097157 | A1 | 5/2006 | Ouyang | |
| 2006/0163468 | A1 | 7/2006 | Wells | |
| 2006/0249671 | A1 | 11/2006 | Karpetsky | |
| 2006/0266941 | A1 | 11/2006 | Vestal | |
| 2007/0114389 | A1 | 5/2007 | Karpetsky | |
| 2007/0187589 | A1 | 8/2007 | Cooks | |
| 2008/0073548 | A1 | 3/2008 | Denton | |
| 2008/0156985 | A1 | 7/2008 | Venter | |
| 2008/0202915 | A1 | 8/2008 | Hieftje | |
| 2009/0272893 | A1 | 11/2009 | Hieftje | |

FOREIGN PATENT DOCUMENTS

| | | |
|---|---|---|
| WO | WO03081205 | 10/2003 |
| WO | WO2004068131 | 8/2004 |
| WO | WO2005094389 | 10/2005 |
| WO | WO2007/103693 | 9/2007 |
| WO | WO2007/140349 | 12/2007 |
| WO | WO2007/140351 | 12/2007 |
| WO | WO2008/046111 | 4/2008 |
| WO | WO2008/054393 | 5/2008 |
| WO | WO2008/082603 | 7/2008 |
| WO | WO2009/023361 | 2/2009 |

OTHER PUBLICATIONS

Cody, R.B. et al., "Versatile New Ion Source for the Analysis of Materials in Open Air under Ambient Conditions" Anal. Chem., 2005, 77, 2297-2302.

Cooks, R.G. et al., "Ambient Mass Spectrometry", Science, 2006, 311, 1566-1570.

Dalton, C.N. et al., "Electrospray-Atmospheric Sampling Glow Discharge Ionization Source for the Direct Analysis of Liquid Samples", Analytical Chemistry, Apr. 1, 2003, vol. 75, No. 7, pp. 1620-1627.

Fenn et al., "Electrospray Ionization for Mass Spectrometry of Large Biomolecules," Science, vol. 246, No. 4926, Oct. 6, 1989, pp. 64-71.

Guzowski, J.P. Jr. et al., "Development of a Direct Current Gas Sampling Glow Discharge Ionization Source for the Time-of-Flight Mass Spectrometer", J. Anal. At. Spectrom., 14, 1999, pp. 1121-1127.

Haddad, R., et al., "Easy Ambient Sonic-Spray Ionization Mass Spectrometry Combined with Thin-Layer Chromatography," *Analytical Chemistry*, vol. 80, No. 8, Apr. 15, 2008, pp. 2744-2750.

Hill, C.A. et al., "A pulsed corona discharge switchable high resolution ion mobility spectrometer-mass spectrometer", Analyst, 2003, 128, pp. 55-60.

Hiraoka, K. et al., "Atmospheric-Pressure Penning Ionization Mass Spectrometry", Rapid Commun. Mass Spectrom., 18, 2004, pp. 2323-2330.

Hites, Gas Chromatography Mass Spectrometry, Chapter 39, Jun. 24, 1997, pp. 609-626.

Karas, M. et al., "Laser desorption ionization of proteins with molecular masses exceeding 10,000 daltons" Anal. Chem. 1988, 60, 2299-2301.

Kojiro, D.R. et al., "Determination of C.sub.1-C.sub.4 Alkanes by Ion Mobility Spectrometry", Anal. Chem., 63, 1991, pp. 2295-2300.

Leymarie, N. et al., "Negative Ion Generation Using a MAB Source", presented at the Annual Meeting of the American Society of Mass Spectrometry, 2000.

McLuckey, S.A. et al., "Atmospheric Sampling Glow Discharge Ionization Source for the Determination of Trace Organic Compounds in Ambient Air", Anal. Chem., 60, 1988, pp. 2220-2227.

Otsuka, K. et al., "An Interface for Liquid Chromatograph/Liquid Ionization Mass Spectrometer", Analytical Sciences, Oct. 1988, vol. 4, pp. 467-472.

Takáts et al., "Mass Spectrometry Sampling Under Ambient Conditions with Desorption Electrospray Ionization," Science, vol. 306, No. 5695, Oct. 15, 2004, pp. 471-473.

Tanaka, K. et al., "Protein and polymer analyses up to m/z 100,000 by laser ionization time-of-flight", Rapid Commun. Mass Spectrom., 1988, 2, 151-153.

Tembreull, R., et al., "Pulsed Laser Desorption with Resonant Two-Photon Ionization Detection in Supersonic Beam Mass Spectrometry," Anal. Chem., vol. 58, 1986, pp. 1299-1303, p. 1299.
Zhao, J. et al., Liquid Sample Injection Using an Atmospheric Pressure Direct Current Glow Discharge Ionization Source, Analytical Chemistry, Jul. 1, 1992, vol. 64, No. 13, pp. 1426-1433.
International Search Report for Int'l Application No. PCT/US07/63006.
International Search Report for Int'l Application No. PCT/US07/69821.
International Search Report for Int'l Application No. PCT/US07/69823.
International Search Report for Int'l Application No. PCT/US07/81439.
Supplementary European Search Report dated Jan. 7, 2010 in Application No. 07757665.0 PCT/US2007/063006, 8 pages.
Supplementary European Search Report dated Mar. 10, 2010 in Application No. 07797812.0 PCT/US2007/069823, 9 pages.
Supplementary European Search Report dated Mar. 25, 2010 in Application No. 07797811.2 PCT/US2007/069821, 9 pages.
Supplementary European Search Report dated Mar. 10, 2010 in Application No. 07844307.4 PCT/US2007/081439, 12 pages.

* cited by examiner

SAMPLING SYSTEM FOR USE WITH SURFACE IONIZATION SPECTROSCOPY

PRIORITY CLAIM

This application is a divisional application of U.S. Utility patent application Ser. No. 11/872,666 "SAMPLING SYSTEM FOR CONTAINMENT AND TRANSFER OF IONS INTO A SPECTROSCOPY SYSTEM" inventor: Brian D. Musselman, filed Oct. 15, 2007, which has issued as U.S. Pat. No. 7,928,364 and which application claims priority to: (1) U.S. Provisional Patent Application Ser. No. 60/851,688, entitled: "A SAMPLING SYSTEM FOR COLLECTION AND TRANSFER OF IONS GENERATED WITH SURFACE IONIZATION TECHNOLOGY", inventors: Brian D. Musselman, filed Oct. 13, 2006. These applications are herein expressly incorporated by reference in their entireties.

CROSS REFERENCE TO RELATED APPLICATIONS

This application is related to the following applications:

(2) U.S. Utility patent application Ser. No. 11/580,323, which issued as U.S. Pat. No. 7,700,913, entitled "SAMPLING SYSTEM FOR USE WITH SURFACE IONIZATION SPECTROSCOPY" by Brian D. Musselman, filed Oct. 13, 2006;

(3) U.S. Utility patent application Ser. No. 12/275,079, entitled "SAMPLING SYSTEM FOR USE WITH SURFACE IONIZATION SPECTROSCOPY" by Brian D. Musselman, filed Nov. 20, 2008;

(4) U.S. Utility patent application Ser. No. 12/683,257, entitled "SAMPLING SYSTEM FOR USE WITH SURFACE IONIZATION SPECTROSCOPY" by Brian D. Musselman, filed Jan. 6, 2010;

(5) U.S. Utility patent application Ser. No. 11/754,115, which issued as U.S. Pat. No. 7,777,181, entitled "HIGH RESOLUTION SAMPLING SYSTEM FOR USE WITH SURFACE IONIZATION TECHNOLOGY" by Brian D. Musselman, filed May 25, 2007; and (6) U.S. Utility patent application Ser. No. 11/754,158, which issued as U.S. Pat. No. 7,714,281, entitled "APPARATUS FOR HOLDING SOLIDS FOR USE WITH SURFACE IONIZATION TECHNOLOGY" by Brian D. Musselman, filed May 25, 2007;

(7) U.S. Utility patent application Ser. No. 11/754,189, which issued as U.S. Pat. No. 7,705,297, entitled "FLEXIBLE OPEN TUBE SAMPLING SYSTEM FOR USE WITH SURFACE IONIZATION TECHNOLOGY" by Brian D. Musselman, filed May 25, 2007;

(8) U.S. Utility patent application Ser. No. 12/709,157, entitled "APPARATUS FOR HOLDING SOLIDS FOR USE WITH SURFACE IONIZATION TECHNOLOGY" by Brian D. Musselman, filed Feb. 19, 2010; and (9) U.S. Utility patent application Ser. No. 12/776,034, entitled "SAMPLING OF CONFINED SPACES" by Brian D. Musselman, filed May 7, 2010, These related applications ((2)-(9)) are herein expressly incorporated by reference in their entireties.

FIELD OF THE INVENTION

The present invention is a device to enable collection of analyte ions and neutral molecules desorbed from liquids and surfaces located outside of the normal ionization region of the spectroscopy system and subsequent transfer of those ions into the instrument for analysis.

BACKGROUND OF THE INVENTION

The development of efficient desorption ionization sources for use with mass spectrometer systems has generated a need for increasing the sampling area around the analysis system available for analysis. While the current sampling systems provides for selective collection of ions from a spot on the surface, that sample surface must be brought into close proximity with the spectrometer inlet to permit analysis. It can be advantageous to increase the area around the spectroscopy system without losing sensitivity. Improving the range of sampling to include a wider area around the spectroscopy system can enable higher throughput analysis, direct analysis of large objects without their displacement, sampling of organs and tissues in-situ and systems containing pathogens by bringing the ions and gases from the remote location to the spectroscopy system after desorption to enable their characterization and detection.

SUMMARY OF THE INVENTION

In various embodiments of the present invention, a 'multiple desorption ionization source' includes a length of tubing which can be used to sample ions formed at a distance from the spectrometer by permitting a decoupling of the ionization source from the spectrometer. In on embodiment of the present invention, a 'multiple desorption ionization source' positioned in close proximity to the surface of the sample utilizes an atmospheric pressure ionization source to analyze the sample. In an embodiment of the present invention, a 'multiple desorption ionization source' positioned in close proximity to the surface of the sample utilizes Direct Ionization in Real Time (DART®) to analyze the sample. In embodiment of the present invention, a 'multiple desorption ionization source' includes electrostatic fields which can be used to direct ions to either individual tubes or a plurality of tubes positioned in close proximity to the surface of the sample being analyzed. In an embodiment of the present invention, a 'multiple desorption ionization source' includes wide diameter sampling tubes which can be used in combination with a vacuum inlet to draw ions and neutrals into the spectrometer for analysis. In an embodiment of the present invention, wide diameter sampling tubes in combination with electrostatic fields improve the efficiency of ion collection. In an embodiment of the present invention, a plurality of flexible capillary tubes can be bundled together to enable transfer of ions and gases to the spectrometer.

In an embodiment of the invention, a tube with a potential applied can be used to transport a plurality of analyte ions from an atmospheric ionization source into a vacuum region of a mass spectrometer. In various embodiment of the invention, a plurality of tubes, one or more of which can be charged, can be used to transport a plurality of analyte ions. By increasing the number of tubes transporting analyte ions, the overall number of analyte ions for analysis can be increased. In an alternative embodiment of the invention, multiple tubes allow more than one surface of a sample to be analyzed simultaneously.

In alternative embodiments of the invention, a plurality of tubes, one or more of which can be charged, can be combined with a plurality of gas separators to transport a plurality of analyte ions from an atmospheric ionization source into a vacuum region of a mass spectrometer. One or more of the plurality of tubes can be flexible. The one or more flexible tubes can be adjusted to scan the surface of the sample. The one or more flexible tubes can be adjusted to contour the shape of the sample.

In embodiments of the invention, the position of the plurality of tubes relative to the sample can be adjusted. The distance from plurality of tube to the sample can be adjusted. Alternatively, the location of the plurality of tubes over the sample can be adjusted such that the plurality of tubes scan over the surface of the sample and characterize changes in the composition of the sample.

In embodiments of the invention, two or more of the plurality of tubes are parallel. In an embodiment of the invention, the outer surface of the parallel tubes can be in contact with each. The outer surface of the tubes can have a capacitive surface. In such an embodiment a potential In an alternative embodiment of the invention, a plurality of ionization sources can be used to analyze a sample under different conditions. In various alternative embodiments of the invention, a plurality of tubes can be used in combination with the plurality of ionization sources.

In an embodiment of the invention, a gas or a liquid can be released at a distance from the plurality of tubes and transferred from an atmospheric ionization source into a vacuum region of a mass spectrometer.

BRIEF DESCRIPTION OF THE DRAWINGS

This invention is described with respect to specific embodiments thereof. Additional features can be appreciated from the Figures in which.

DETAILED DESCRIPTION OF THE INVENTION

Figure 1:
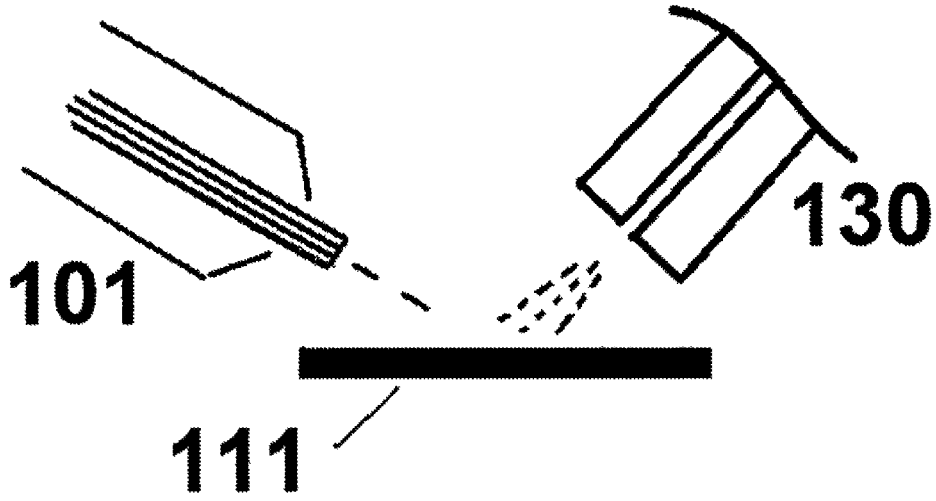
Fig. 1 (Prior Art)
FIG. 1 shows a diagram of an ion sampling device that provides for collection of ions and transmission of ions from their site of generation to the spectrometer system inlet.

Direct Ionization in Real Time (DART®) (Cody, R. B., Laramee, J. A., Durst, H. D. "Versatile New Ion Source for the Analysis of Materials in Open Air under Ambient Conditions" Anal. Chem., 2005, 77, 2297-2302 and Desorption Electrospray Surface Ionization (DESI) (Cooks, R. G., Ouyang, Z., Takats, Z., Wiseman., J. M. "Ambient Mass Spectrometry", Science, 2006, 311, 1566-1570 are two recent developments for efficient desorption ionization sources with mass spectrometer systems. DART® and DESI offer a number of advantages for rapid real time analysis of analyte samples. However, there remain encumbrances to the employment of these techniques for a variety of samples and various experimental circumstances. For example, it can be advantageous to complete sampling surfaces that cannot be brought into immediate proximity of the spectroscopy system without destruction of the sample. Improving the range of distance over which analysis can be completed has implications for medical and security applications where movement of the sample into the normal confines of an atmospheric pressure ionization source is not possible without dissection or complicated sampling protocols. Thus there is a need for increased the capability of collecting and transferring ions from their desorption site to the inlet of the spectroscopy system.

Previous investigators have completed studies involving the use of desorption ionization methods such as Matrix Assisted Laser Desorption Ionization (MALDI) (Tanaka, K., Waki, H., Ido, Y., Akita, S., and Yoshida, Y, "Protein and polymer analyses up to m/z 100,000 by laser ionization time-of-flight" Rapid Commun. Mass Spectrom., 1988, 2, 151-153; Karas, M., Hillenkamp, F., Anal, Chem. "Laser desorption ionization of proteins with molecular masses exceeding 10,000 daltons" 1988, 60, 2299-2301 Mass Spectrometry (MS) in ultra-high vacuum. The desorption of selected biomolecules with reliable determination of the site of desorption has been reported for MALDI and other ionization systems such as secondary ion desorption (SIMS) and fast atom bombardment (Barber, M. Bordoli, R. S., Elliot, G. J., Sedgwick, R. D., Tyler, A. N., "Fast atom bombardment of solids (F.A.B.): a new ion source for mass spectrometry." J. Chem. Soc. Chem. Commun., 1981, 325. These experiments have been completed by using samples under high vacuum desorption conditions inside of the mass spectrometer. Reports regarding the use of Atmospheric Pressure MALDI (AP-MALDI), DART® and DESI have also been published although in all cases reported, the sampling system used has been a simple capillary tube or sub-300 micron sized inlet with little or no modification of that inlet to provide for accurate sampling of the site of desorption.

In other experiments, investigators report the use of chemical modification of the surface of the MALDI target to create receptors for selection of specific types of chemical classes of molecules for subsequent desorption. In these systems the separation of the different analyte types from one another is brought about by the action of chemical and biochemical entities bound to the surface. The original location of the molecule of interest on the sample surface or its local environ is not normally retained with these systems. Sophisticated assays that incorporate the use of surface bound antibodies selectively retain specific proteins and protein-conjugates derived from serum, blood and other biological fluids. These assays allow isolation of molecules of interest on a surface for analysis by spectroscopic methods. The use of short to moderate length oligonucleotides immobilized on surfaces to bind specific complimentary strands of nucleotides derived from DNA, and RNA has also been have been demonstrated for isolating molecules of interest on surfaces. Although these systems have excellent performance characteristics they are used for concentrating the sample without respect to its original position in the sample and thus information regarding the position from which a molecule of interest originates is limited to the information derived by using the original sample isolation system.

In the case of MALDI with the sample under high vacuum it is possible to effectively ionize samples from a very small, well-defined spot that has dimensions defined by the beam of light from the source and optics used to focus the radiation on the target. The lower limit of spot diameter ranges between 30 to 50 microns for Nitrogen-based lasers based on the optics employed to focus the 337 nm light source used in the majority of MALDI-TOF instruments. Although designs and lasers vary, it is difficult to ionize a sufficiently large enough number of ions needed to provide a detectable signal after mass separation once one reduces the ionizing laser beam diameter below 30 microns. The implication here is that with current technology it is difficult to spatially resolve components of a surface that are not spaced at a distance greater than 100 micron in the typical MALDI-TOF and 50 micron in instruments designed with high resolution ionization capability in mind. More recently the DART® ionization technique has been used to complete desorption of ions from surfaces at ground potential or samples to which little or no potential applied to the surface. DART® technology involves the use of metastable atoms or molecules to efficiently ionize samples. In addition, surface ionization by using electrospray as proposed in DESI enable desorption of stable ions from surfaces. Fundamentally these technologies offer investigators the capability to ionize materials in a manner that allows for direct desorption of molecules of interest from the surface to which they are bound selectively. Indeed, published reports have shown such results along with claims of enabling reasonable spatial resolution for molecules on surfaces including leaves, biological tissues, flower petals, and thin layer chromatography plates. Both DESI and DART® can ionize molecules present in a very small spot with good efficiency, however the spot size from which desorption occurs is large compared with MALDI. Normal area of sampling in the DART® experiment is approximately 4 $mm^2$ in diameter, which is over 1000 times greater than the area sampled during MALDI. As a consequence reports of high-resolution sampling with both DART® and DESI have not supported the use of these technologies for examination of surfaces with high resolution.

Prior art in API-MS includes many different designs that combine the action of electrostatic potentials applied to needles, capillary inlets, and lenses as well as a plurality of lenses act as ion focusing elements, which are positioned in the ion formation region effect ion focusing post-ionization at atmospheric pressure. These electrostatic focusing elements are designed to selectively draw or force ions towards the mass spectrometer inlet by the action of the electrical field generated in that region of the source. Atmospheric pressure sources often contain multiple pumping stages separated by small orifices, which serve to reduce the gas pressure along the path that the ions of interest travel to an acceptable level for mass analysis, these orifices also operate as on focusing lenses when electrical potentials are applied to the surface.

Current configuration of atmospheric pressure ionization (API) mass spectrometer inlets are designed to use either a capillary or small diameter hole to effectively suction ions and neutral molecules alike into the mass spectrometer for transmission to the mass analyzer. The use of metal, and glass capillaries to transfer ions formed at atmospheric pressure to high vacuum regions of a mass spectrometer is implemented on many commercially available mass spectrometers and widely applied in the industry. The function of the capillary tubing is to enable both transfer of ions in the volume of gas passing through the tube and to reduce the gas pressure from atmosphere down to vacuum pressures in the range of millitorr or less required by the mass spectrometer. The flow of gas into and through the capillary is dependent on the length and the diameter of the capillary.

In an embodiment of the present invention, a sampling system utilizes larger diameter tubing to provide for more conductance and thus more efficient transfer of ions and molecules into the spectrometer analysis system for measurement. In an embodiment of the invention a collection of flexible capillary tubes assembled into an array or large diameter tube which can be enabled with electrostatic fields inside the tubes can further enhance collection and transfer of ions into the spectrometer system further improving the sensitivity of the system. The outlet of the collection of tubes can have a reduced diameter in order to increase the flow of gas containing ions into the mass spectrometer inlet.

In an embodiment of the present invention, one or more tubes are circular, oval, ellipsoid, rectangular, square in cross sectional shape. In an embodiment of the present invention, one or more of the tubes are cylindrical in profile. In an embodiment of the present invention, one or more tubes surround the sample to form a sampling chamber. In an embodiment of the invention, one or more tubes with an inner diameter of the cylinder greater than 10 microns and less than 1 centimeter can be used. In various embodiments of the invention, one or more tubes with an outer diameter greater than 100 microns and less than 10 centimeter can be used.

Methods

The sampling chamber can have one or more inlet for the ionizing gas or charged particle stream. The sampling chamber can have one or more inlets for the ionizing gas or charged particle stream positioned to enable ionization of the sample. The outlet of the sampling chamber can have one or more tubes positioned in such a way as to transport ions, atoms and neutral molecules produced in the sampling chamber. The sampling chamber can be fabricated from electrically conducting material in order to direct ions to the sampling chamber outlet by using electrostatic focusing elements. The sampling chamber can contain one or more electrostatic lenses to focus ions produced from the sample. The sampling chamber can be constructed from a porous material.

Advantages

In an embodiment of the invention, ions desorbed from the surface can be drawn into the spectrometer system through a device made from a single tube connected to the vacuum system of the spectrometer. In an embodiment of the invention, ions desorbed from the surface can be drawn into the spectrometer system through a device made from a plurality of tubes, where one or more tubes are arranged in series, connected to the vacuum system of the spectrometer. In an embodiment of the invention, ions desorbed from the surface can be drawn into the spectrometer system through a device made from a plurality of tubes, where each tube can be acting in parallel, connected to the vacuum system of the spectrometer. In an embodiment of the invention, ions desorbed from the surface can be drawn into the spectrometer system through a device made from a plurality of tubes, where one or more tubes are arranged in parallel and one or more tubes are arranged in series, where one or more of the tubes are connected to the vacuum system of the spectrometer.

In an embodiment of the present invention, a sampling system utilizes a plurality of tubing located around the sample to provide for more conductance and thus more efficient transfer of ions into the spectrometer analysis system for measurement. The utilization of a plurality of tubes and in addition the larger diameter tube often used and the implementation of electrostatic fields inside the plurality of tubes results in enhanced collection and transfer of ions into the mass spectrometer system further improving the sensitivity of the system.

In an embodiment of the present invention, a plurality of tubes can be positioned in close proximity to the surface of a sample to selectively collect ions from an area of interest. The plurality of tubes can permit more efficient collection of ions during the desorption process by improving the capability of the system to capture ions.

The area of sample subject to the ionizing gas during desorption ionization can be relatively large in both of the recently developed DART® and DESI systems. The capability to determine the composition of a specific area of sample can be limited to a few cubic millimeters. In an embodiment of the present invention, a plurality of small diameter capillary tubes can be positioned in close proximity to the sample in order to more selectively collect ions from a specific area, where the plurality of tubes compensates for the decrease in the collection efficiency resulting from the reduced diameter of each of the plurality of capillary tubes.

In an embodiment of the present invention, a plurality of narrow orifice tubes can be positioned in close proximity to the surface of a sample to selectively collect ions from an area of interest. The plurality of narrow orifice tubes described permit increased collection of ions during the desorption process while retaining the improved resolution of the system based on the inner diameter of the tubes.

In an embodiment of the present invention, a plurality of narrow orifice tubes with electrical potentials applied to the inside surface of each tube can be positioned in close proximity to the surface of a sample to selectively collect ions from an area of interest while a second electrical potential, applied to the outer surface of each of the tubes acts to deflect ions that are not generated in the area of interest away from the sampling inlet of the tube. In an embodiment of the present invention, the various sampling systems described permit more efficient collection of ions during the desorption process by improving the capability of the system to capture the ions.

The introduction of samples into the sampling chamber can be continuous in order to provide for on-line sampling of materials. The sampling tube can have a variety of inlets to enable the simultaneous introduction of multiple samples, samples and standards, and samples of different composition into the sampling chamber. The transport of samples into and through the sampling chamber can be facilitated by mechanical pumps and motors such as a pneumatic actuator or gravity feed to push or drop the sample into position for desorption analysis. The sampling chamber can contain an inlet that introduces ions or neutral gases which can be used as reagents for subsequent reaction with the sample.

In an embodiment of the invention, one or more external sources for desorption and ionization of the samples can be interfaced to the sampling chamber in order to complete vaporization of portions of the sample, the complete sample or molecules surrounding the sample. The sampling chamber acts as a containment device for ions and neutrals formed from the desorption enabling the collection of those ions and neutrals for transport to the spectrometer.

In an embodiment of the invention, a plurality of tubes are interfaced to the sampling chamber in order to complete collection of the ions and gases produced by the desorption process. The sampling chamber can be shaped in order to provide for more efficient collection of the ions. In an alternate form the sampling chamber can be a single surface, two sided, three sided, or incomplete cylinder that covers the sample in order to contain the sample and permit collection of ions and gases for transfer to the spectroscopy system. The sample can be a conducting material.

In an embodiment of the present invention, a narrow orifice tube with an electrical potential applied to its inside surface can be positioned in close proximity to the surface of a sample to selectively collect ions from an area of interest while a second electrical potential, can be applied to the outer surface of the tube to deflect ions that are not generated in the area of interest away from the sampling inlet of the tube. In an embodiment of the present invention, the various sampling systems described can permit more efficient collection of ions during the desorption process by improving the capability of the vacuum system to capture the ions.

A desorption ionization source 101 generates the carrier gas containing metastable neutral excited-state species, which can be directed towards a target surface 111 containing analyte molecules as shown in FIG. 1. Those analyte molecules can be desorbed from the surface 111 and ionized by the action of the carrier gas. Once ionized, the analyte ions can be carried into the spectrometer system through the vacuum inlet 130.

The area of sample subject to the ionizing gas during desorption ionization can be relatively large in both of the recently developed DART® and DESI systems. The capability to determine the composition of a specific area of sample can be limited to a few cubic millimeters. In an embodiment of the present invention, a small diameter capillary tube can be positioned in close proximity to the sample in order to more selectively collect ions from a specific area. Unfortunately, use of reduced diameter capillary tube results in a decrease in the collection efficiency for the analysis.

The material being used as a physical barrier to block the desorption of molecules from area adjacent to the area of interest can be exposed to the same ionizing atoms or molecules that are used to desorb and ionize molecules from the targeted area of the surface. In the case of DART®, these atoms and molecules are gases and not likely to condense on the surface, however in DESI special considerations must be taken to remove the liquids that might condense on the physical barrier because these molecules might subsequently be ionized and thus contribute ions to the system. The accumulation of liquid on the physical barrier might then result in new ions being generated from the physical barrier surface. The effect of the presence of an electrical field on the barrier can potentially reduce resolution of the sampling system since the charged ions in the DESI beam can be deflected while passing through the slit or orifice thus defeating the purpose of its use as a physical barrier, Clearly, this situation is not ideal for accurate determination of the spatially resolving small areas of a surface.

In an embodiment of the invention, ions desorbed from the surface can be drawn into the spectrometer system through a device made from either a single tube, or plurality of tubes connected to the vacuum system of the spectrometer. In an embodiment of the invention, ions desorbed from the surface can be drawn into the spectrometer system through a device made from a plurality of tubes connected to the vacuum system of the spectrometer. In an embodiment of the invention, a tube can be cylindrical in shape. In an embodiment of the invention, a tube can be elliptical in shape. In an embodiment of the invention, a cylindrical tube can be used and the diameter of the cylinder can be greater than 100 microns. In an alternative embodiment of the invention, a cylindrical tube diameter of 1 centimeter can be used. In various embodiments of the invention, a cylindrical tube diameter greater than 100 microns and less than 1 centimeter can be used.

Figure 2:
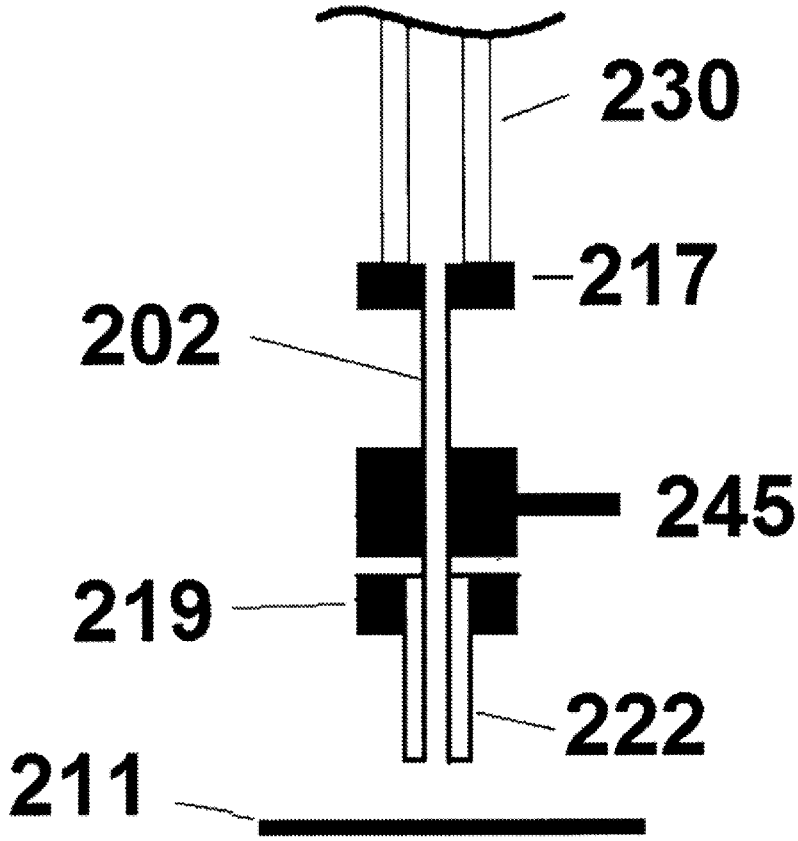
FIG. 2 shows a schematic diagram of a sampling system incorporating a resistively coated glass tube with a modified external surface.

In an embodiment of the invention, a tube can be conical in shape with greater diameter at the sample inlet and smallest diameter at mass analyzer inlet. In an embodiment of the invention, a conical tube can be used and the smaller diameter can be 100 microns. In an alternative embodiment of the invention, a conical tube with largest diameter of 1 centimeter can be used. In various embodiments of the invention, a conical tube with smallest diameter greater than 100 microns and largest diameter less than 1 centimeter can be used. In an embodiment of the invention, a tube can be variegated in shape. In an embodiment of the invention, an inner surface of the tube or plurality of tubes can be capable of supporting an electrical potential which can be applied in order to retain and collimate ions generated during the desorption ionization process. FIG. 2 shows a device fabricated by using a resistively coated glass tube 202 the exterior surface of which has been coated with a conducting material such as a metal 222 to enable application of potential to the surface through an electrode 219 connected to the conducting material. Another electrode 217 can be attached to the resistively coated tube in order to permit application of an electrical potential to the inside surface of the tube 202. The tube assembly can be positioned above the sample surface 211 by using a holder 245, which enables lateral and horizontal movement of the tube assembly to permit analysis of different sections of the sample. Once molecules are ionized during the desorption process are in the vapor phase they are either carried into the spectrometer system through the vacuum inlet 230 or deflected away from the entrance of the tube leading to the vacuum inlet if they are outside of the area of interest by the action of the electrical field applied to the external surface of the tube.

The movement of the tube using the holder 245 can be directed by a light source such as a laser or a light emitting diode affixed to the tube 202 or holder 245 which interacts with one or more photo detectors embedded in the surface 211. Once an integrated circuit senses the position of the tube 202 at various positions over the surface 211, a systematic sample analysis of the surface 211 can be carried out. A person having ordinary skill in the art would appreciate that such a device can have application for analysis of lab on a chip devices and in situ screening of samples of biological origin.

The use of resistively coated glass for ion guides is well established. By design, these tubes are fabricated into assemblies that result in ions being injected into the ion guide for transfer between locations in a vacuum system or as mass analyzers (e.g., in a reflectron or ion mirror). Resistively coated glass tubes operated with the same polarity as the ions being produced act by directing the ions towards the lowest electrical potential, collimating them into a focused ion beam.

In an embodiment of the present invention, the potential applied to the inner surface of a resistively coated glass tube acts to constrain and direct ions towards its entrance while at the same time pushing them towards the exit of the tube as the potential decreases along the length of the internal surface of the tube. In an embodiment of the present invention, by locating the tube near the area of desorption, and applying a vacuum to the exit end of a tube results in more efficient collection of ions from a wide area. In an embodiment of the invention, collection of ions can be suppressed by the action of an electrical potential applied to a tube. In an embodiment of the invention, collection of ions can be suppressed by the action of a vacuum applied to the tube exit. In an embodiment of the present invention, application of a potential to the outer surface of the tube, which has been modified to support an electrical potential results in deflection of ions that are not in the ideal location for capture by the action of the electrical and vacuum components of the tube. In an embodiment of the present invention, the application of a potential to the tube results in sampling only from a specified volume of the surface from which ions are being formed. In various embodiments of the present invention, differences in the diameter of tube and the vacuum applied to it serve to define the resolution of the sampling system. In an embodiment of the present invention, smaller diameter tubes result in higher resolution. In an embodiment of the present invention, larger diameter tubes permit collection of more ions but over a wider sample surface area.

Figure 3:
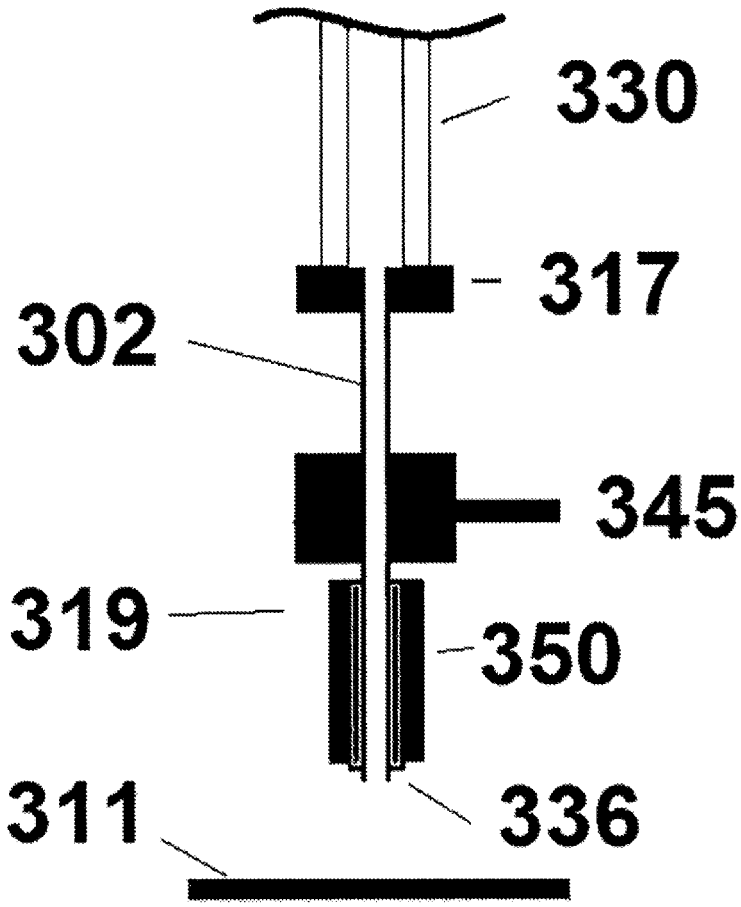
FIG. 3 shows a schematic diagram of the sampling system incorporating a metal tube with an insulating external surface over which a second metal tube is placed.

FIG. 3 shows the sampling device fabricated by using electrical conducting tubes such as metal tubes. In an embodiment of the invention, ions desorbed from the surface can be drawn into the spectrometer system through a device made from a single conducting tube 302 of a diameter ranging from 100 micron to 1 centimeter where ions are desorbed from the surface 311 by the desorption ionization carrier gas (not shown). In an embodiment of the invention, the surface of the tube shall be capable of supporting an electrical potential which when applied acts to retain ions generated during the desorption ionization process. In order to deflect ions that are not formed in the specific sample area of interest from being collected into the tube 302 a second tube 350, electrically isolated from the original tube by a insulating material 336 can be employed in a coaxial configuration as shown. A separate electrode 319 can be attached to the exterior conducting surface 350. The second tube 350 covers the lower portion of the outer surface of the conducting tube 302. A second electrical potential of the same or opposite polarity can be applied to this outer surface to provide a method for deflection of ions that are not produced from the sample surface area directly adjacent to the sampling end of the electrical conducting tube 302. An electrode 317 can be attached to the tube 302 in order to permit application of an electrical potential to the inside surface of the tube. The outer tube can also be comprised of a conducting metal applied to the surface of the insulator. The tube assembly can be positioned above the sample surface 311 by using a holder 345, which enables lateral and horizontal movement of the tube assembly to permit analysis of different sections of the sample. Once ionized the analyte ions are carried into the spectrometer system through the vacuum inlet 330.

In an embodiment of the present invention., the potential applied to the inner surface can be negative while the potential applied to the outer surface can be positive. In this configuration positive ions formed in the area directly adjacent to the end of the conductive coated (e.g., metal) glass tube can be attracted into the tube, since positive ions are attracted to negative potential while positive ions formed outside of the volume directly adjacent to the tube are deflected away from the sampling area thus preventing them from being collected and transferred to the spectrometer.

In an embodiment of the present invention, the potential applied to the inner surface can be positive while the potential applied to the outer surface can be negative. In this configuration negative ions formed directly in the area directly adjacent to the end of the conductive (e.g. metal) coated glass tube can be attracted into the tube, since negative ions are attracted to positive potential while negative ions formed outside of the volume directly adjacent to the tube can be deflected away from the sampling area thus preventing them from being measured.

In an embodiment of the present invention, the use of a short piece of resistive glass can reduce the opportunity for ions of the opposite polarity to hit the inner surface of the glass and thus reduce potential losses prior to measurement.

Figure 4:
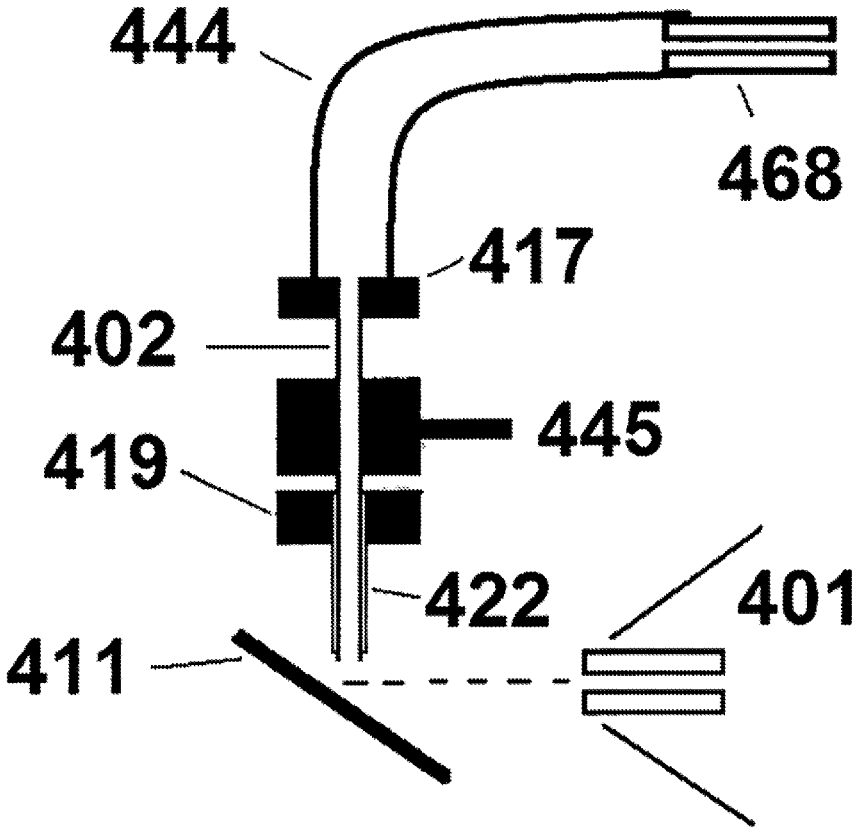
FIG. 4 shows a schematic diagram of an ion sampling device configured to provide a path for ions from the sampling device to the inlet of an API-mass spectrometer through a flexible tube or segmented tube to permit flexibility in location of the sampling device with respect to the sample being subject to desorption ionization.

In an embodiment of the present invention, the use of multiple segments of either flexible 444 or rigid tube can permit more efficient transfer of ions via, a device made from a conductive coated (e.g., metal) tube 402, from the area where they are desorbed into the sampler device to the spectrometer analyzer 468, as shown in FIG. 4. In an embodiment of the present invention, the tube can be positioned at a right angle to the carrier gas. In an embodiment of the present invention, the tube can be orientated 45 degrees to the surface being analyzed. In an embodiment of the present invention, the tube can be orientated at a lower limit of approximately 10 degrees to an upper limit of approximately 90 degrees to the surface being analyzed. In an embodiment of the present invention, the tube can be attached at one end to the mass spectrometer vacuum system to provide suction for capture of ions and neutrals from a surface 411 being desorbed into the open end of a tube 402 in the sampler device. A desorption ionization source 401 generates the carrier gas containing metastable neutral excited-state species, which are directed towards a target surface containing analyte molecules. The tube assembly can be positioned above the sample surface 411 by using a holder 445, which enables lateral and horizontal movement of the tube assembly to permit analysis of different sections of the sample. An electrode 417 can be attached to the resistively coated tube 402 in order to permit application of an electrical potential to the inside surface of the tube. An electrode 419 can be attached to the external, conducting surface of the tube 422 in order to permit application of an electrical potential to the outer surface of the tube.

Figure 5:
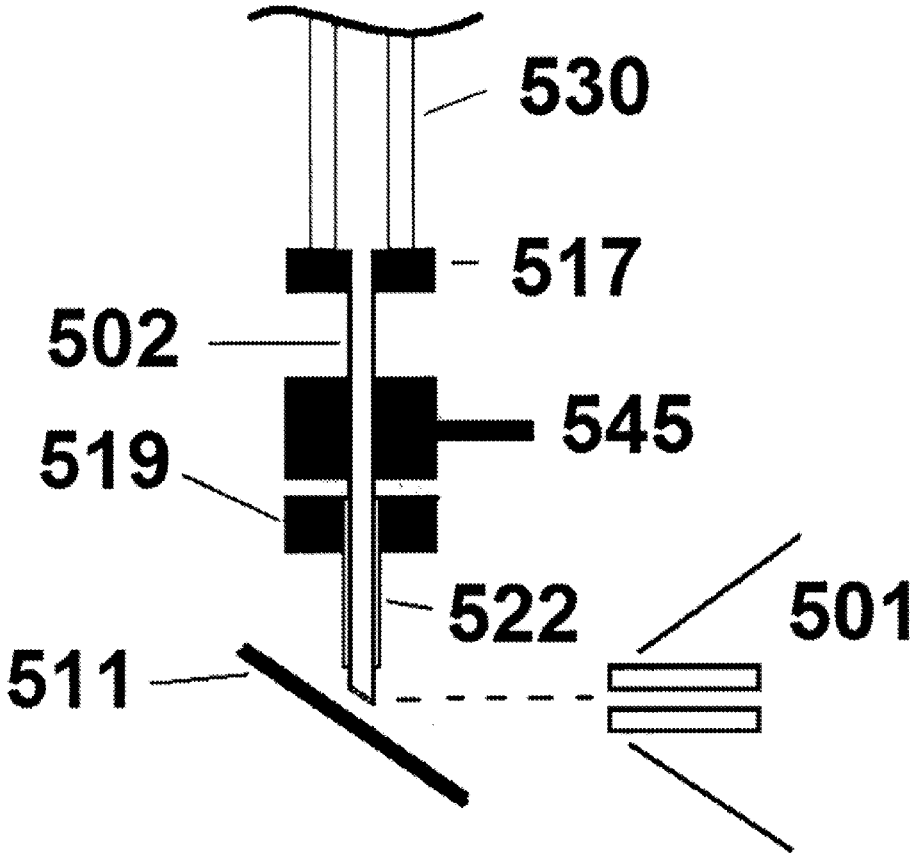
FIG. 5 shows a schematic diagram of the configuration of the sampling device with a shaped entrance allowing for closer sampling of the sample.
Figure 13:
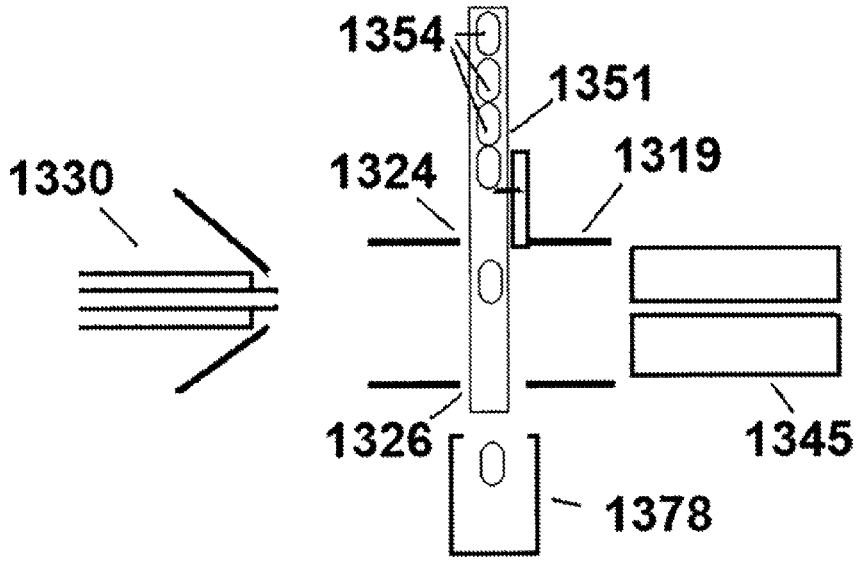
FIG. 13 shows a schematic diagram of a sample chamber with entry and exit openings that permit entry and removal of sample.

In various embodiments of the present invention, sample desorption surfaces at a variety of angles are used to avoid complications associated with the use of slits and orifices described earlier (FIG. 13). In an embodiment of the present invention, a sample collection tube with its opening having an angle that more closely matches the angle at which the surface being analyzed 511 can be positioned with respect to the ionization source and used to effect more efficient collection of the ions and neutrals formed during the desorption ionization process (FIG. 5). The use of a tube 502 the end of which has been designed and fabricated to be complimentary with respect to the angle of presentation of the surface 511 from which the ions are being desorbed can be attached at one end to the mass spectrometer vacuum system to provide more efficient collection of ions and neutrals from the surface as they are desorbed into the open end of the tube 502 in the sampler device. A desorption ionization source 501 generates the carrier gas containing metastable neutral excited-state species, which are directed towards a target surface containing analyte molecules. The tube assembly can be positioned above the sample surface 511 by using a holder 545, which enables lateral and horizontal movement of the tube assembly to permit analysis of different sections of the sample. An electrode 517 can be attached to the resistive coating tube 502 in order to permit application of an electrical potential to the inside surface of the tube. Once ionized the analyte ions are carried into the spectrometer system through the vacuum inlet 530. An electrode 519 can be attached to the external, conducting surface of the tube 522 in order to permit application of an electrical potential to the outer surface of the tube.

Figure 6:
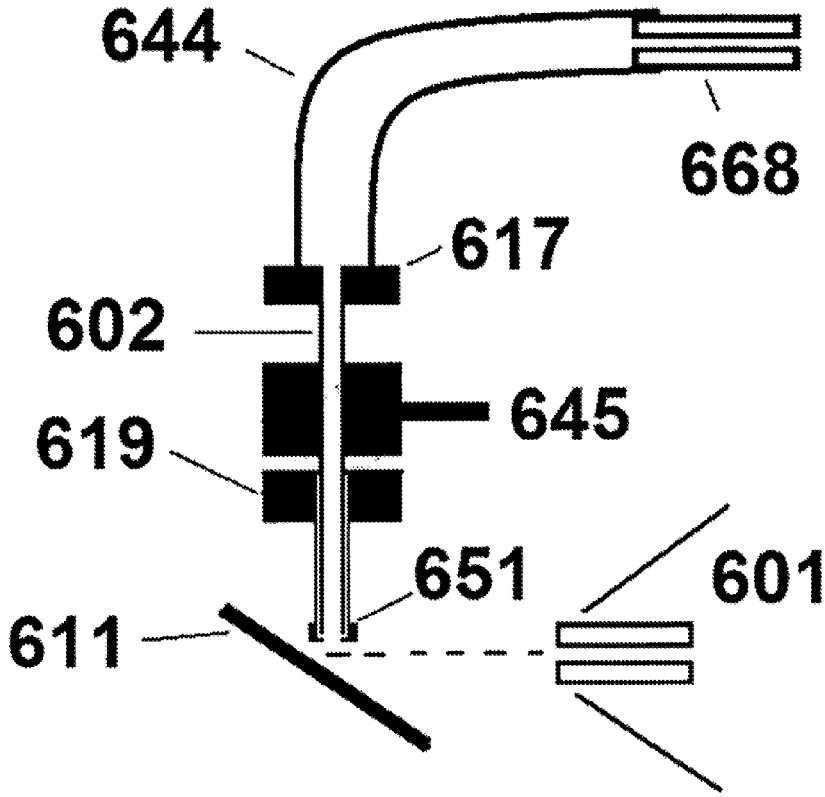
FIG. 6 shows a schematic diagram of an ion sampling device that provides for collection of ions and transmission of ions from their site of generation to the spectrometer system inlet showing a physical restriction of the gas being used to effect desorption ionization.

In an embodiment of the invention, ions can be drawn into the spectrometer by an electrostatic field generated by applying a potential through an electrode 651 to a short piece of conducting tubing can be electrically isolated from a longer piece of conductive coated (e.g., metal) tubing to which an electrical potential of opposite potential to the ions being produced has been applied (as shown in FIG. 6). The short outer conducting tube can be placed between the sample and the longer inner conducting tube 602 and has a diameter that can be greater than the diameter of the inner tube 602. The diameter of the inner tube 602 can be between 100 micron and 1 centimeter. In an embodiment of the invention, ions desorbed from the surface 611 by the desorption ionization carrier gas from the ionization source 601 are initially attracted to the outer tube 651 however due to the relatively low electrical potential applied to the outer tube the ions pass into the inner tube 602. In an embodiment of the invention, the surface of the tube 602 can be capable of supporting an electrical potential which when applied acts to retain ions generated during the desorption ionization process. An electrode 617 can be attached to the resistive outside coating of the inner tube 602 in order to permit application of an electrical potential to the inside surface of the tube. The tube assembly can be positioned above the sample surface 611 by using a holder 645, which enables lateral and horizontal movement of the tube assembly to permit analysis of different sections of the sample. Once ionized the analyte ions are carried into the spectrometer system through tube 644 into the vacuum inlet 668.

High Throughput Sampling

While DART® and DESI are attractive ways of analyzing samples without any sample work-up, the sensitivity and selectivity can be significantly improved if a preparative step is introduced in the analysis protocol. For example, LCMS increases the ability to detect ions based on the chromatographic retention time and mass spectral characteristics. Similarly, selective sample retention prior to MS analysis can be important for improving the ability of DART® and DESI to distinguish samples. Further, selective sample retention can be important for improving surface ionization efficiency. In an embodiment of the present invention, samples for DART®/DESI analysis are trapped by affinity interactions. In an embodiment of the present invention, samples for DART®/DESI analysis are trapped by non-covalent interactions. In an embodiment of the present invention, samples for DART®/DESI analysis are trapped covalent bonds. In an embodiment of the present invention, covalent bonds can be hydrolyzed prior to the sample measurement. In an embodiment of the present invention, covalent bonds can be hydrolyzed simultaneous with the time of sample measurement. In an embodiment of the present invention., covalent bonds vaporization or hydrolysis can occur due to the action of the desorption ionization beam. In an embodiment of the present invention, chemically modified surfaces can be used to trap samples for DART®/DESI analysis.

In an embodiment of the present invention, a thin membrane of plastic material containing molecules of interest can be placed either in-line or along the transit axis of the DART® gas. In an embodiment of the present invention, a high temperature heated gas exiting the DART® source can be sufficient to liquefy or vaporize the material. In an embodiment of the present invention, a use of a high temperature to heat gas for use in the DART® experiment results in pyrolysis of plastic polymer releasing molecules of interest associated with the polymer.

In an embodiment of the present invention, ions desorbed from samples can be transported into a high vacuum region through a plurality of tubes. With these samples a desorption gas (DART®) or charged ion (DESI) can ionize the sample and the analyte ions together with the gas or charged ions can flow through the tubes. Analyte ions formed when the analyte sample is deposited on either the end surface or inside the tubes (or a perforated sample) can be transported through the tubes into the high vacuum region by the action of the vacuum.

Figure 7:
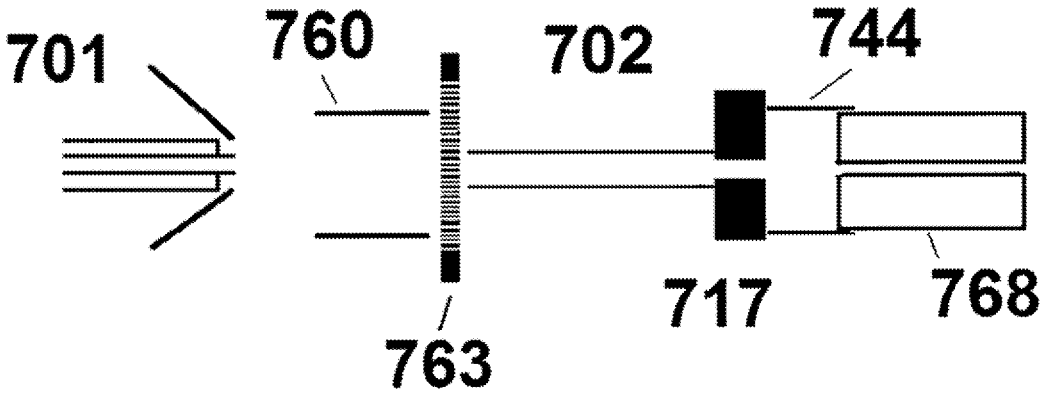
FIG. 7 shows a schematic diagram showing a collimating tube placed between the desorption ionization source and the sample being analyzed with the sampling device in position to collect ions desorbed from the sample.

In an embodiment of the invention, the metastable atoms or metastable molecules that exit the DART® source 701 are directed through a tube 760 to which an electrical potential can be applied establishing an electrostatic field that more effectively constrains the ions created during desorption from the sample 763 as shown in FIG. 7. In an embodiment of the present invention, a tube 760 acts to constrain the ions as they are formed in the desorption event by the action of the electrostatic field maintained by the voltage applied to the tube. The tube can be made from metal or conductively coated glass to which a potential can be applied so as to force the ions away from the tube. The target sample can be positioned along the transit path of the flow of the DART® gas in a position where vaporization of the molecules from the target occurs. The sample can be made to move so as to permit presentation of the entire surface or specific areas of the surface for desorption analysis. A device made from a conductive-coated (e.g., metal) tube 702 transmits the ions formed to a transfer tube 744 where they are drawn into the spectrometer through an API like-inlet 768. An electrode 717 can be attached to the resistively coated tube 702 in order to permit application of an electrical potential to the inside surface of the tube.

Figure 8:
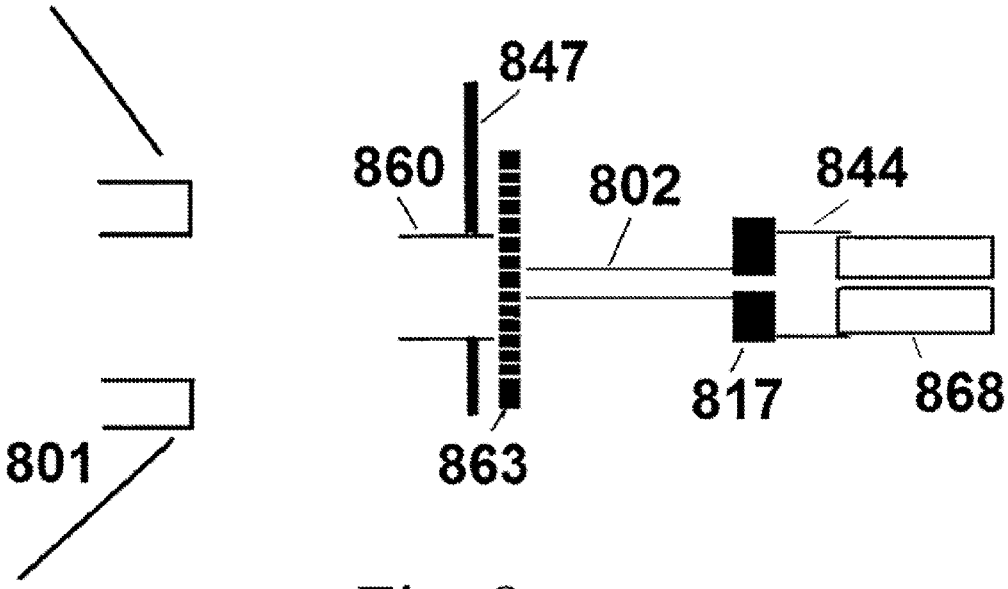
FIG. 8 shows a schematic diagram showing a high resolution sampler with the collimating tube mounted between the desorption ionization source and the sample being analyzed with the sampling device in position to collect ions being desorbed.
Figure 9:
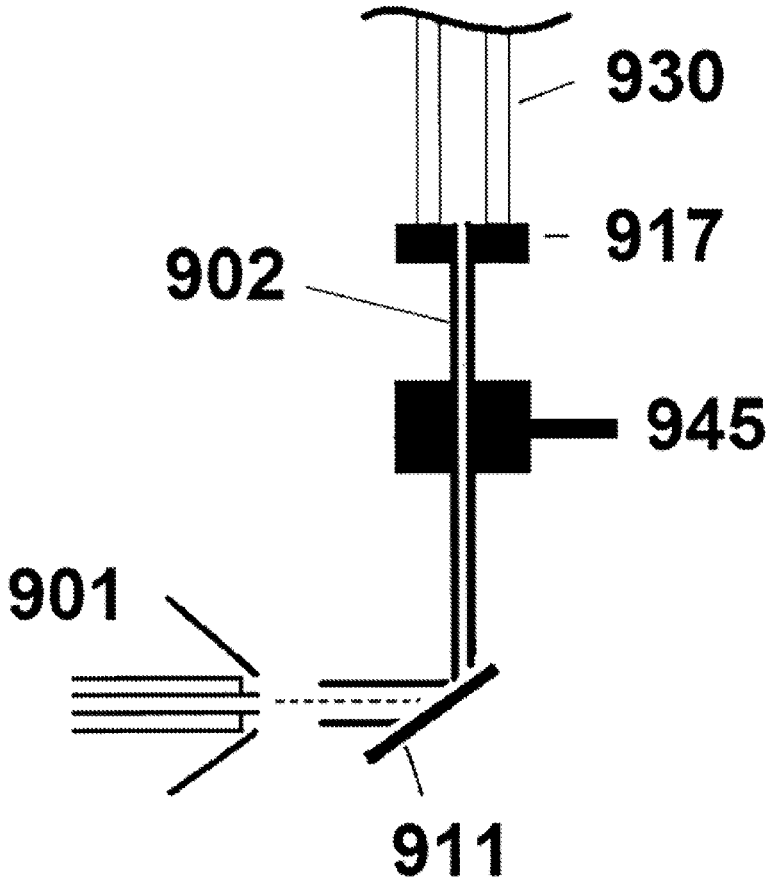
FIG. 9 shows a schematic diagram of a off-axis sampling device including a collimating tube placed between the desorption ionization source and the sample being analyzed with the entrance of the spectroscopy system inlet being off-axis.

In an embodiment of the invention, the metastable atoms or metastable molecules that exit the DART® source or the DESI desorption gas 801 are directed through a tube 860 to which an electrical potential can be applied establishing an electrostatic field that more effectively constrains the ions created during desorption from the sample 863 as shown in FIG. 8. In an embodiment of the present invention, in order to enable completion of higher resolution sampling of the surface, the diameter of tube 863 can be reduced and a shield 847 can be introduced to restrict the flow of the desorption ionizing gas to specific areas of the sample surface as shown in FIG. 8. A device made from a conductive-coated (e.g., metal) tube 802 transmits the ions into the API like-inlet 868 of the spectrometer system through a transfer tube 844. An electrode 817 can be attached to the resistively coated tube 802 in order to permit application of an electrical potential to the inside surface of the tube. In an embodiment of the present invention, the distance between the tube 860 and the electrode 802 can be adjusted to provide for optimum ion collection and evacuation of non-ionized material and molecules so they are not swept into the mass spectrometer inlet.

In various embodiments of the present invention, the sample 763 (FIG. 7), 863 (FIG. 8) can be a film, a rod, a membrane wrapped around solid materials made from glass, metal and plastic. In the case of a plastic membrane the sample can have perforations to permit flow of gas through the membrane. In an embodiment of the present invention, the action of the carrier gas from the ionization source can be sufficient to permit desorption of analyte from the membrane at low carrier gas temperatures. In an embodiment of the present invention, the action of the carrier gas can be sufficient to provide for simultaneous vaporization of both the membrane and the molecules of interest. In an embodiment of the present invention, the DART® gas temperature can be increased to effect vaporization. In an embodiment of the present invention, the sample holder can be selected from the group consisting of a membrane, conductive-coated tubes, metal tubes, a glass tube and a resistively coated glass tube. In an embodiment of the present invention, the function of these sample supports can be to provide a physical mount for the sample containing the molecules of interest, in an embodiment of the present invention, the membrane holder can be a wire mesh of diameter ranging from 500 microns to 10 cm to which a variable voltage can be applied to effect electrostatic focusing of the ions towards the mass spectrometer atmospheric pressure inlet after they are formed.

Figure 10A:
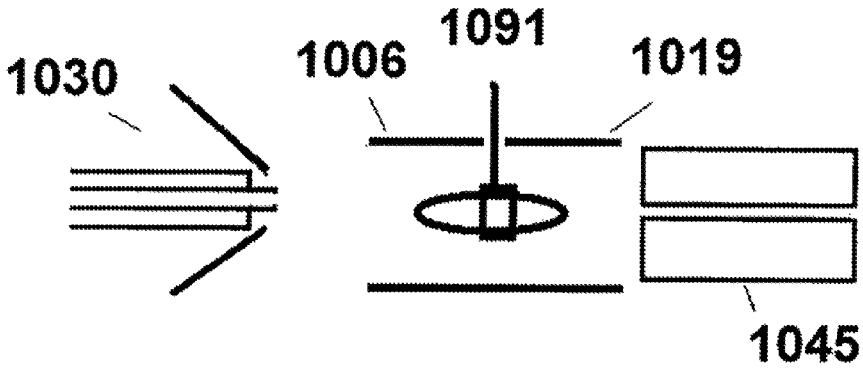
FIG. 10A shows a schematic diagram of a sample positioning device for placement of samples on-axis and inside a sample chamber on-axis with a single inlet tube.
Figure 10B:
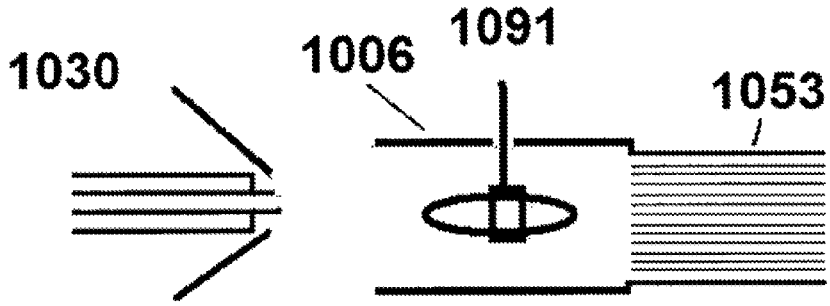
FIG. 10B shows a schematic diagram of a sample positioning device for placement of samples on-axis and inside a sample chamber on-axis with a plurality of inlet tubes in a bundle.
Figure 10C:
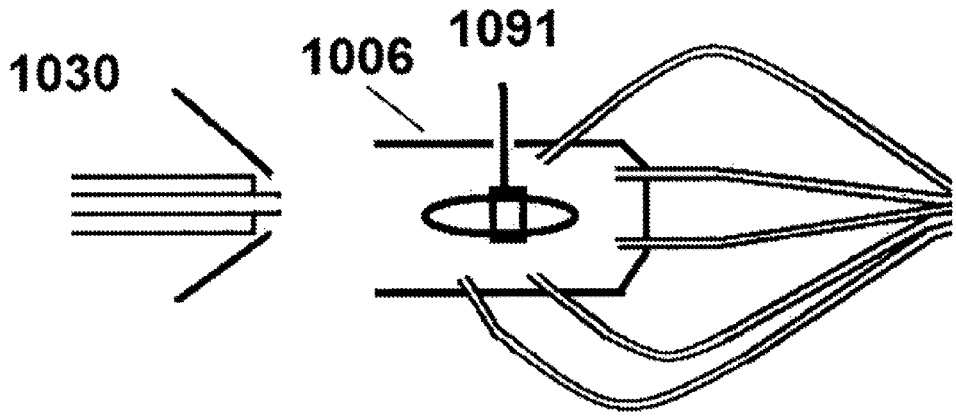
FIG. 10C shows a schematic diagram of a sample positioning device for placement of samples on-axis and inside a sample chamber on-axis with a plurality of flexible inlet tubes arrayed around the sample.

In an embodiment of the present invention shown in FIG. 10A, the sample can be placed on a holder 1091 for positioning inside a cylinder, tube, box or other confined space 1006 in a position where it can be exposed to the ionizing gases from the source 1030. As the sample is ionized, the ions formed in the sample chamber can be subsequently swept into the inlet tube of a gas separator 1045. In an alternate configuration FIG. 10B the outlet of the sampling chamber can be made up of a plurality of tubes connected at their terminus to the inlet of a spectroscopy system. In an alternate configuration FIG. 10C, the multiple tubes 1064 can be positioned about the sampling chamber 1006 in order to provide to collect ions desorbed from the sample for distribution to one or more spectroscopy systems. In all system the use of flexible fused silica tubing with various internal diameters can be used to effect a mobile sampling capability. The tubes can be surrounded by material to apply heat to the tubes in order to reduce the potential for condensation of molecules on the internal surface of the tubes. Alternatively, devices can be used to irradiate the surfaces to heat the tubes. The use of short tubes or a plurality of tubes at the inlet entrance can permit simple cleaning of the tubes. Alternatively, replacement of short tubes or short portions of tubes can be carried out should they become contaminated during the sampling process.

Figure 11A:
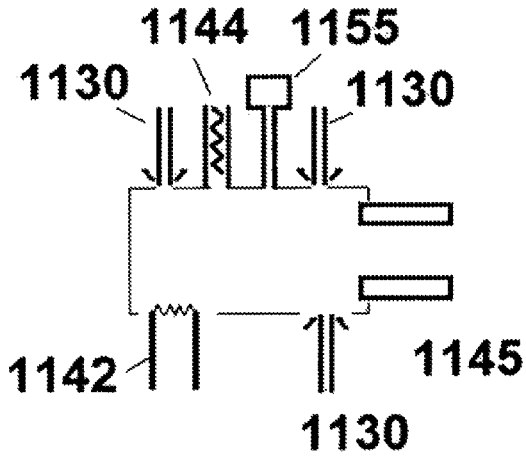
FIG. 11A shows a schematic diagram of a sample chamber with a plurality of desorption ionization sources as well as sources of energy that might assist in desorption of sample spaced around it.
Figure 11B:
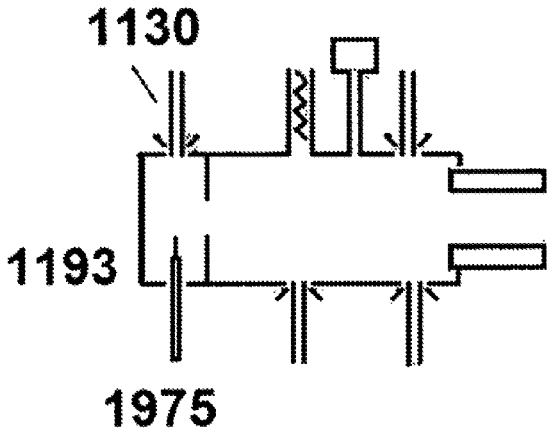
FIG. 11B shows a schematic diagram of a sample chamber with a plurality of desorption ionization sources capable of ionizing material in multiple chambers as well as sources of energy that might assist in desorption of sample spaced around it.

In an embodiment of the invention, FIG. 11A multiple ionization sources 1130 can be utilized to effect ionization of the sample. Coupling of ionization with devices such as but not limited to laser light sources 1144, infrared radiation 1142, ultraviolet radiation, visible electrical discharge, and molecular beams 1155 can be used to vaporize molecules from or of the sample. The addition of one or more secondary ionization chambers 1193 attached to the original sample chamber as shown in FIG. 11B can provide for generation of ions for use as external standards, ions for ion molecule reactions, and mixtures of ions for use as chemical ionization reagents that might be necessary for analysis. The samples can be positioned in the secondary chamber by using a probe, tube for liquid introduction, or gas inlet 1175.

Figure 12:
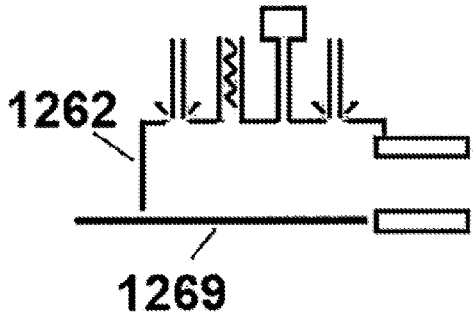
FIG. 12 shows a schematic diagram of a sample chamber one or more sides of which is comprised of the sample.

We have described the use of tubes and enclosures to maintain a directed flow of ionizing gas across the surface of the sample. In many cases where surface ionization may be applicable, such as in the analysis of large solid objects too valuable to break into a small sample, (e.g., building walls, floors, ceilings, industrial machinery, cells, tissues and liquid surfaces) the application of a half-shell, half-cylinder, or custom shaped cylinder to complete the sampling enclosure can be carried out as shown in FIG. 12. The placement of a sampling dome 1262 on a sample effectively creates the sampling chamber as shown for a solid flat surface 1269.

The potential for high throughput analysis of samples can use a flow through sampling system. In an embodiment of the invention FIG. 13 a system of openings 1324, 1326 in the sampling chamber 1319 can be configured so as to permit the transfer of sample or samples 1354 to and from, or through the ionization region inside of the sample chamber 1319 or half-chamber. The transfer of sample can be competed by use of a continuous feed device 1351 powered by electromechanical motors, gravity, pneumatic actuators and other devices capable of pushing or pulling the sample through the openings 1324, 1326. The continuous feed device can be loaded with samples which drop through the ionization region into a waste container 1378, or sample archiving device 1345. In the case where a mass spectrometer is used for the analysis the relative distribution of ions desorbed from the sample serve to permit characterization of the samples (e.g., good or bad) based on their mass and/or their ion distribution.

Advantages

An advantage with using a plurality of tubes is that it increases the number of analyte ions transporting analyte ions into the MS and thereby increases the overall sensitivity of the MS. Another advantage with using a plurality of tubes is that analyte ions from more than one surface of a sample to be analyzed can be simultaneously transported. Compared with a single wide tube, a plurality of narrow tubes offers an advantage in correlating the analyte ions to a particular position or coordinate on the surface of the sample.

Uses

A plurality of charged tubes can be combined with a variety of atmospheric ionization sources including DART®, DESI and atmospheric pressure MALDI used in MS. In each case by increasing the number of ions introduced into the MS, the sensitivity of the technique can be increased. The gas separator can also be used in a number of other spectroscopic devices that rely on transferring ions formed at approximately atmospheric pressure or low vacuum to regions of high vacuum for detection. The gas separator can also be used in surface science spectroscopic devices that preferably operate at ultra high vacuum where ions formed by a process that introduces a gas would be deleterious and therefore removal of the gas would be beneficial. The gas separator can also be used with other analyte detectors including a raman spectrometer, an electromagnetic absorption spectrometer, an electromagnetic emission spectrometer and a surface detection spectrometer. The kinds of analyte detectors that can be used with a gas separator are not limited to those specified but include those detectors that a person having ordinary skill in the art would envisage without undue experimentation.

In an embodiment of the invention, a tube with a potential applied can be used to transport a plurality of analyte ions from an atmospheric ionization source into a vacuum region of a mass spectrometer. In various embodiment of the invention, a plurality of tubes, one or more of which can be charged, can be used to transport a plurality of analyte ions. By increasing the number of tubes transporting analyte ions, the overall number of analyte ions for analysis can be increased. In an alternative embodiment of the invention, multiple tubes allow more than one surface of a sample to be analyzed simultaneously.

Wire mesh cage includes a perforated tube where the holes can be machined or alternatively a porous ceramic, etc. The term "based on as used herein, means "based at least in part on", unless otherwise specified. A vacuum of atmospheric pressure is 1 torr. Generally, 'approximately' in this pressure range encompasses a range of pressures from below $10^1$ torr to $10^{-1}$ torr. A vacuum of below $10^{-3}$ torr would constitute a high vacuum. Generally, 'approximately' in this pressure range encompasses a range of pressures from below $5\times10^{-3}$ torr to $5\times10^{-6}$ torr. A vacuum of below $10^{-6}$ torr would constitute a very high vacuum. Generally, 'approximately' in this pressure range encompasses a range of pressures from below $5\times10^{-6}$ torr to $5\times10^{-9}$ torr. In the following, the phrase 'high vacuum' encompasses high vacuum and very high vacuum. The term approximately 1 second refers to a range of time of between 100 msec and 10 seconds. The term approximately 10 minutes refers to a range of time of between 1 minute and 100 minutes.

A capacitive surface is a surface capable of being charged with a potential. A surface is capable of being charged with a potential, if a potential applied to the surface remains for the typical duration time of an experiment, where the potential at the surface is greater than 50% of the potential applied to the surface.

A gas separator comprises an external ion source and a jet separator. A gas separator can be any device capable of stripping small neutral atoms or molecules from a charged species being transferred into a high vacuum region. A tube is any enclosed surface with two partially or completely open ends. The cross section of an end of a tube can be circular, oval, ellipsoid, rectangular, square or one or more shapes derived there from. The surface of the tube can be in the shape of a rectangular box, multiple sided box, capsule or cylinder device. The term 'inlet tube' will be used to refer to the low vacuum side of the gas separator. The term 'outlet tube' will be used to refer to the high vacuum side of the gas separator. The term 'entrance' will be used to refer to the low vacuum side of either the inlet or the outlet tubes of the gas separator. The term 'exit' will be used to refer to the high vacuum side of either the inlet or the outlet tubes of the gas separator.

EXAMPLE 1

Figure 14:
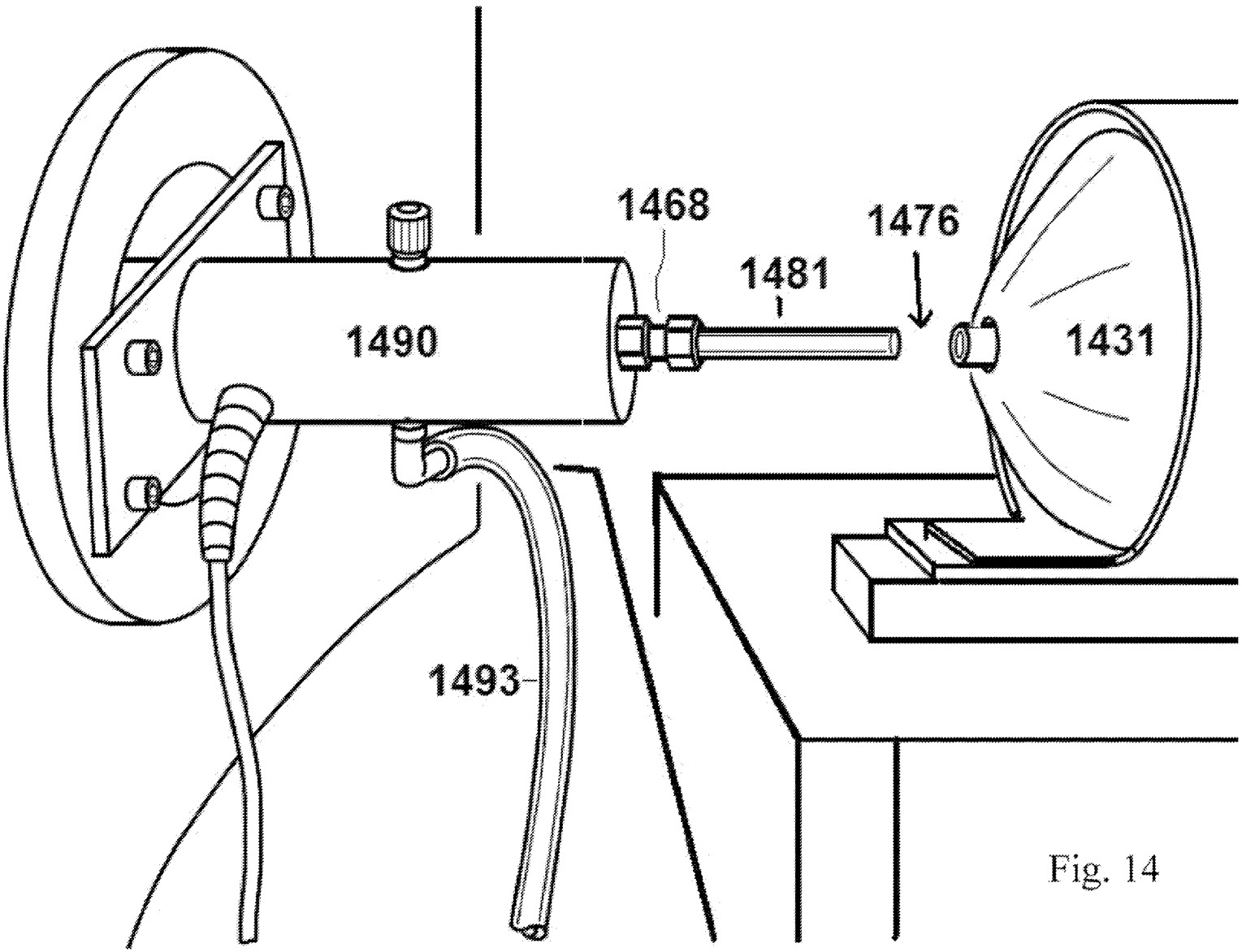
FIG. 14 shows a schematic diagram of an embodiment of a 'multiple desorption ionization source' with a multiple inlet tube gas sampling system.

In various embodiments of the invention, a 'multiple desorption ionization source' was used to transfer ions and neutrals into the spectroscopy system. In an embodiment of the invention, a 'multiple desorption ionization source' included a plurality of tubes for analysis of a sample. In an embodiment of the invention, the increased gas flow from a plurality of tubes can be accommodated by incorporating a gas ion separator, a device that allows the sampling of large volumes of gas where the gas contains analyte ions for spectroscopic analysis. For example a gas ion separator can be used to accommodate larger diameter sampling tubes for sampling the area surrounding the site of desorption ionization. Utilizing a gas ion separator equipped spectroscopy system, a multiple inlet tube gas sampling system was set up, as shown in FIG. 14, to support multiple experiments using the same sample either simultaneously or at sequential intervals of time. In an embodiment of the invention, a gas ion separator 1490 is attached by a vacuum tight fitting to the atmospheric pressure inlet of the spectroscopy system while a second vacuum tight connection is made to the gas ion separator 1468 with its internal connections to the spectroscopy system and a secondary vacuum pump, the combination of which serves to increase the flow of gas (containing ions and neutral products) into the spectroscopy system while removing excess neutral carrier gas. In an embodiment the gas ion separator has a short, rigid inlet tube 1468 which serves to collect carrier gas and desorbed ions from the source ionization volume 1476 immediately adjacent to the exit of the source 1431. The effect of increasing the vacuum in the gas ion separator is to improve flow of gas containing ions into the short inlet tube 1481 thus improving sensitivity of the spectroscopy system.

Figure 15:
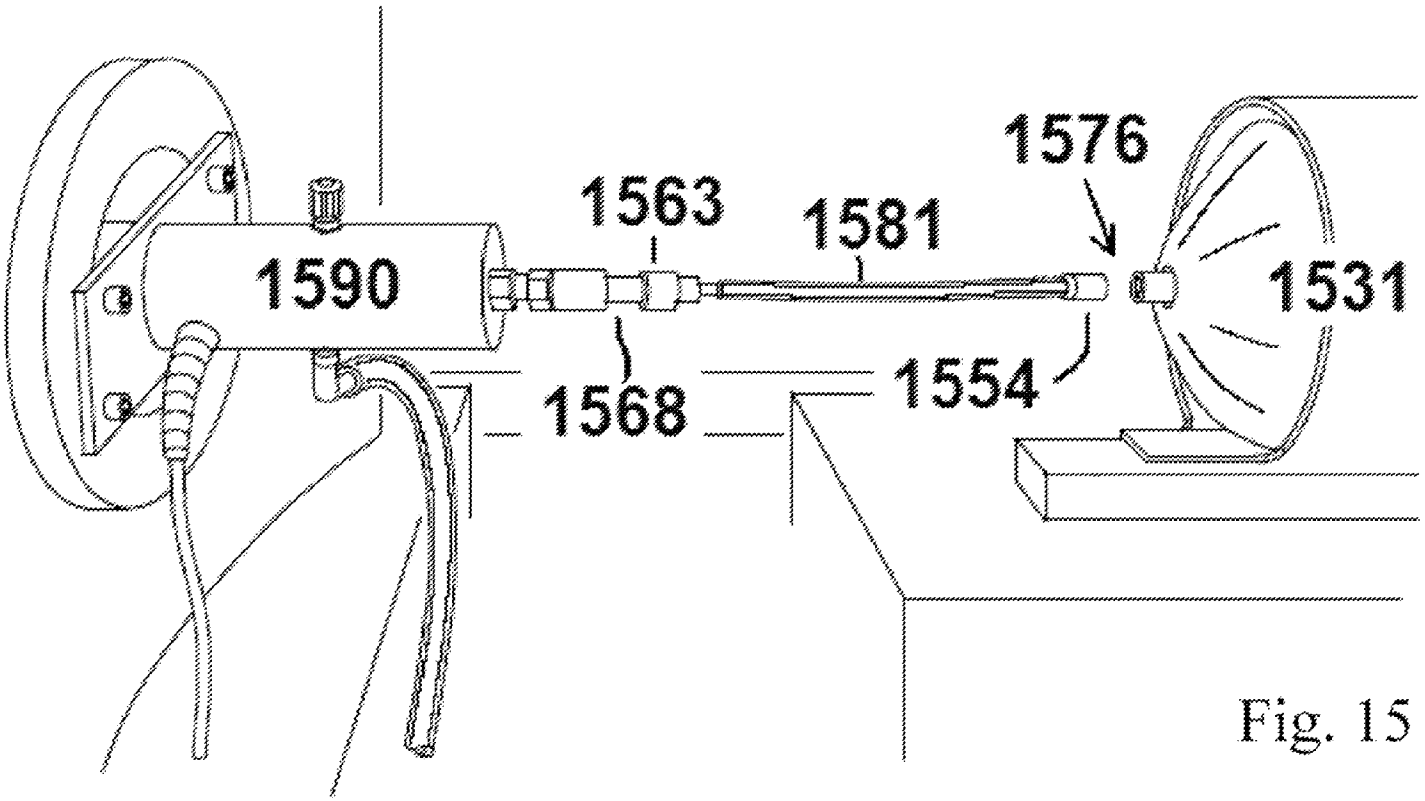
FIG. 15 shows a schematic diagram of an embodiment of a 'multiple desorption ionization source' with a length of flexible tube.

In an embodiment of the invention, a 'multiple desorption ionization source' included a longer length of a plurality of tubes for analysis of a sample. In order to develop more efficient remote sampling capability a length of flexible plastic tube is attached to the short inlet tube as shown in FIG. 15. In this embodiment of the invention a 30 cm length of flexible Teflon® (a plastic) tubing 1581 with an internal diameter of 2 mm was connected to the inlet tube 1563 entrance of the gas ion separator 1590 using a gas tight fitting connector 1563 to enable evacuation of the desorption ionization region 1576 approximately 30 cm (12 inches) distal from an ionization source 1531. A conical shaped adaptor 1554 was used to improve collection of the ions of interest derived from the sample.

Figure 16:
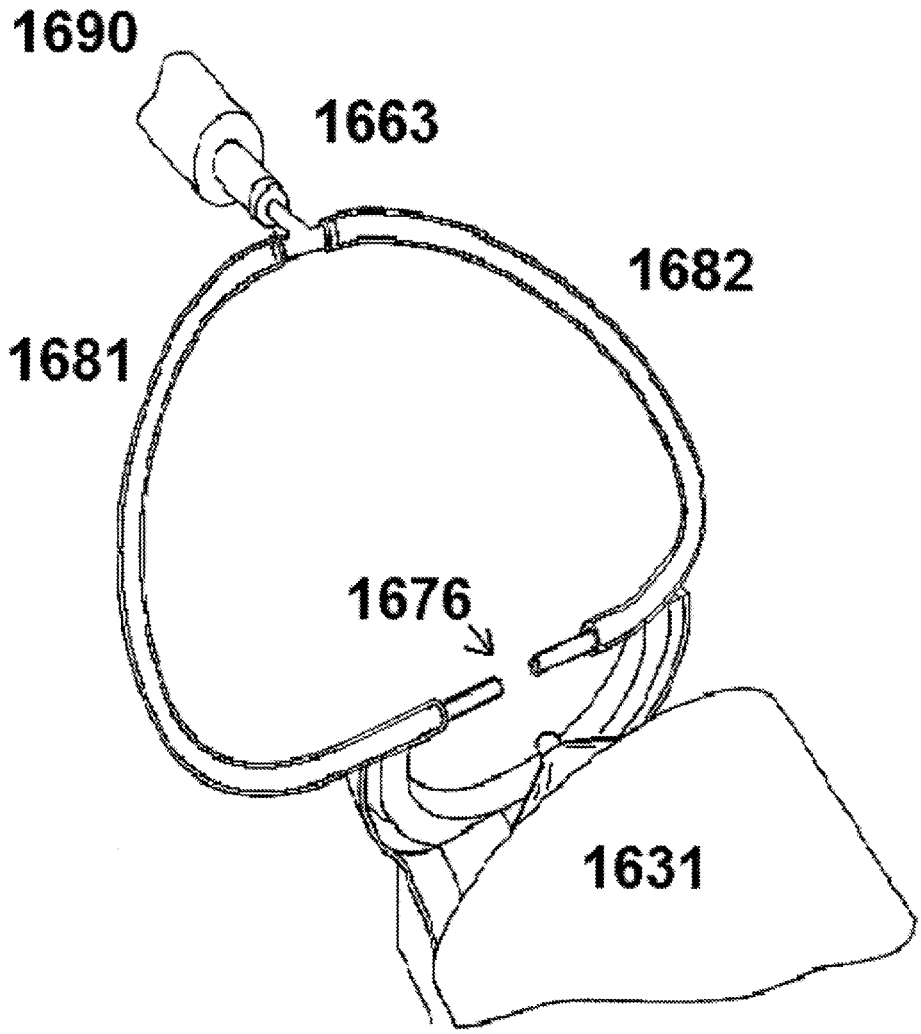
FIG. 16 shows a schematic diagram of an embodiment of a 'multiple desorption ionization source' where a two flexible tubes connect with a metal tee-connector attached to the inlet side of a gas ion separator.

In an embodiment of the invention, a 'multiple desorption ionization source' included a plurality of tubes for analysis of a sample as shown in FIG. 16. The addition of a second flexible tube 1682 was completed using a metal tee-connector 1663 attached to the inlet side of the gas ion separator 1690. The sampling entrance of these two inlet tubes 1681 and 1682 were arranged to collect ions and gases simultaneously from both sides of the sample positioned in a desorption ionization region 1676 thus enabling a more representative sampling of the sample positioned adjacent to the ionization source 1631.

Figure 17:
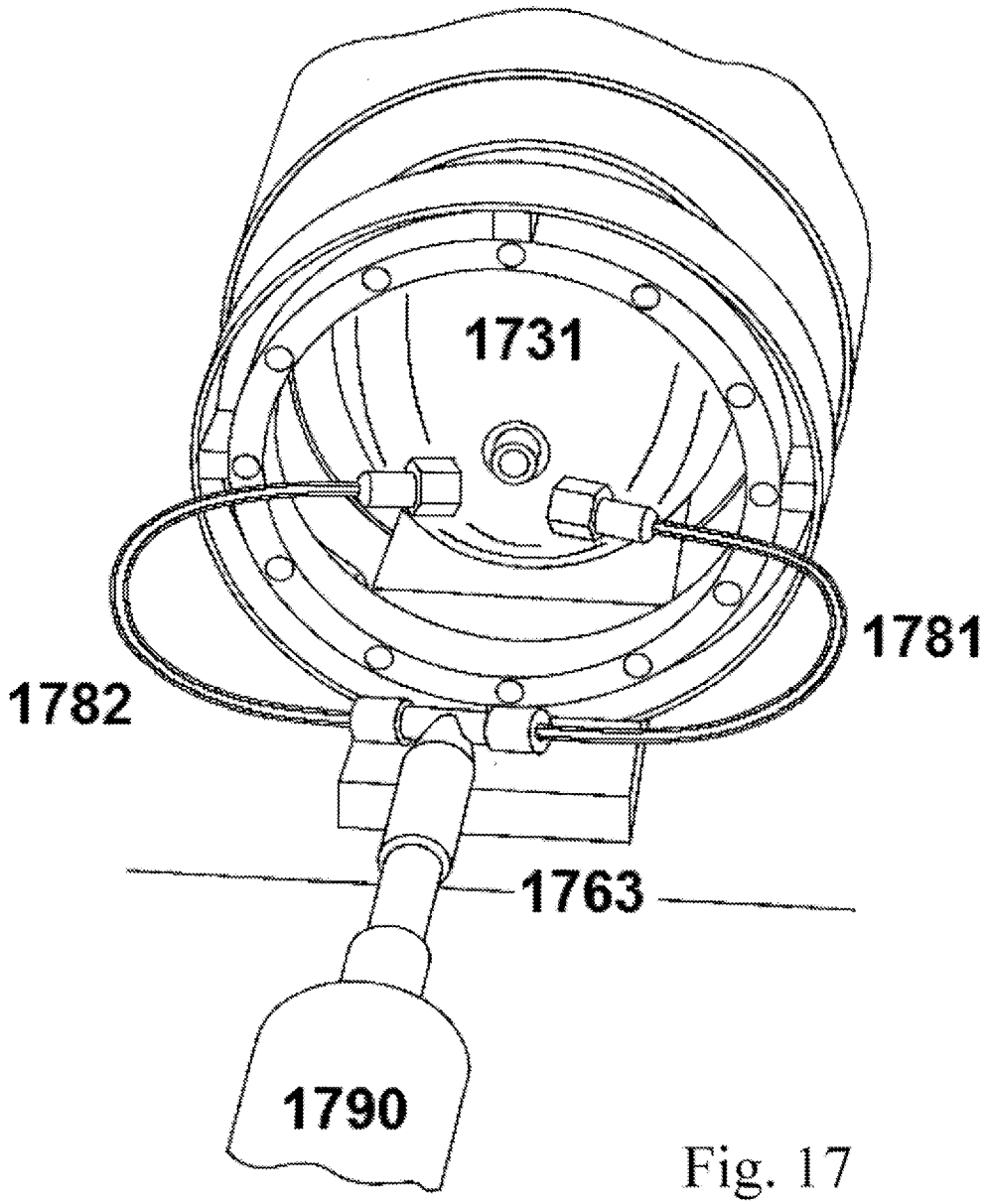
FIG. 17 shows a schematic diagram of an embodiment of a 'multiple desorption ionization source' where the diameter of the inlet tubes was increased in order to increase the flow of gas containing ions from the desorption ionization region into the gas ion separator. The diameter of the inlet tubes, the tee, and the metal orifices positioned at opposite sides of the desorption ionization region were all increased to improve instrument sensitivity.

In an embodiment of the invention, a 'multiple desorption ionization source' included a plurality of wider diameter inlet tubes in order to increase the flow of gas containing ions from a desorption ionization region into the gas ion separator as shown in FIG. 17. The increase in gas flow was accomplished by changing the type of material used for the inlet tube and increasing the internal diameter of the inlet tubes 1781, 1782 to allow for collection of larger volumes of gas from the sampling area. The tee 1763 is attached by a vacuum tight fitting to the gas ion separator 1790 equipped spectroscopy system. In various applications the distal end of the inlet tubes 1781, 1782 can be either the plastic itself and or metal orifices positioned at opposite sides of a desorption ionization region 1776 immediately adjacent to the ionization source 1731.

Figure 18A:
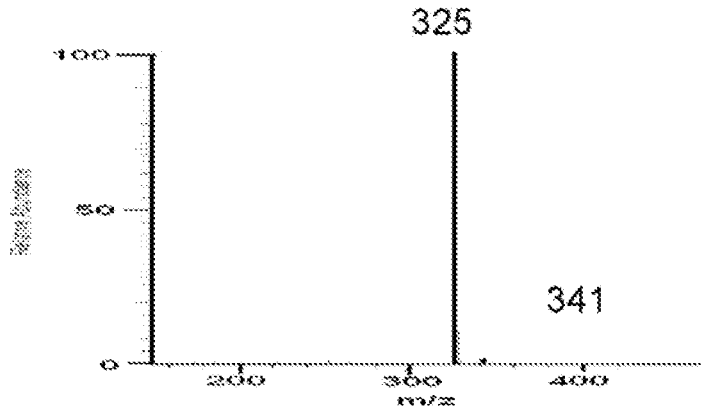
FIG. 18 shows the mass spectra of Quinine measured (A) with a standard DART® source (showing the protonated molecule at 325 Dalton and the oxidized protonated molecule at 341 Dalton); (B) with a source in which the neutral excited species and ions in the neutral gas stream travel 3 cm in air; and (C) using a 1.0 m long×6.5 mm inside diameter plastic tube.
Figure 18B:
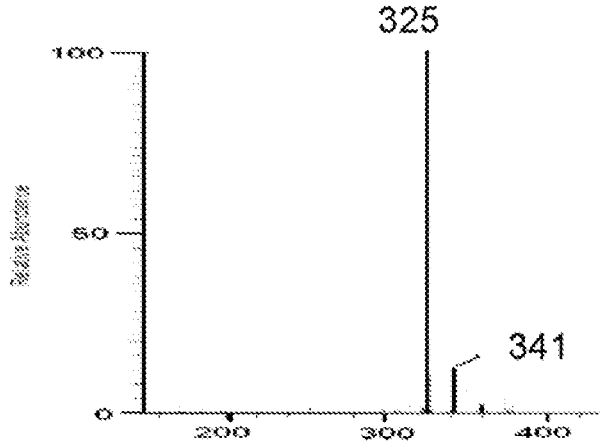
Figure 18C:
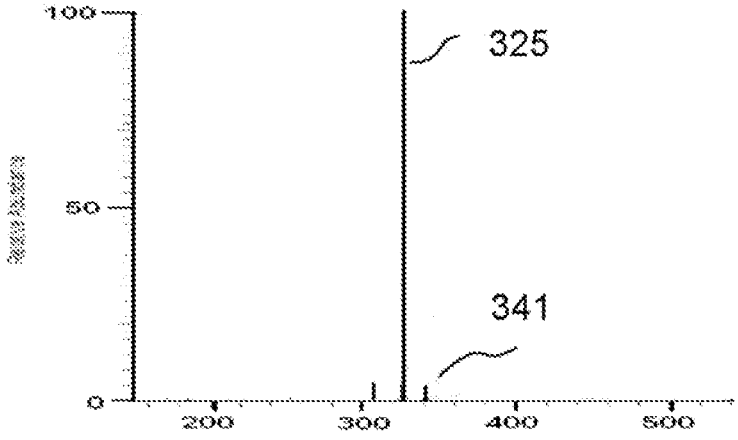

Previously, collection of ions and transfer from an atmospheric pressure region into the spectroscopy system utilized glass lined metal or all metal capillary tubes with inert surfaces. These glass lined metal or all metal capillary tubes permit only a limited volume of gas to pass through their length due to their small inside diameter which ranges from 0.150 mm to 0.5 mm in width. These tubes need to be heated to reduce the potential for condensation in the tube. In an embodiment of the present invention, utilizing relatively inert Tygon® tubing with a wide 6 mm (¼ inch) inside diameter the capture of greater volumes of a gas containing ions drawing those materials into the spectroscopy system. The initial assumption prior to experimentation was that the efficiency of ion transfer through this plastic tubing would be limited due to the fact that along with the carrier gas, ions, and other desorbed materials large volumes of air containing oxygen would also be drawn into the system. Initial use of short lengths of tubing proved that while oxygen was being drawn into the system, its interaction with ionized molecules did not eliminate those ionized molecules before they could be detected and therefore the tubes might be useful for collecting and transferring ions. In an unexpected result, plastic tubes attached to the gas ion separator showed little loss of signal based on the total ion abundance as determined by measuring known quantities of the easily oxidized molecule Quinine. With a conventional direct analysis in real time mass spectrometry source Quinine is typically used for sensitivity assessment. In various embodiments of the invention, Teflon® tubing segments with a length of approximately 0.25 meter and approximately 2 mm inside diameter were used to transfer ions from the ionization region into the gas ion separator with between approximately 10+/−5% loss of ion abundance compared to a conventional DART® experiment where no tubing was used for ion transfer. In an embodiment of the invention, segments of Tygon® tube with a length of approximately 0.5 m (20 inches) and an inside diameter of 6.5 mm can be used to transfer ions from the ionization region into the gas ion separator with slightly greater loss of approximately 20+/−10%. In an embodiment of the invention, the distal end of these segments of Tygon® tubing and Teflon® tubing were either cut to shape to match the surface of a sample, fitted with different diameter metal tubes, and or different diameter glass tubes. These metal caps provided nearly equivalent ion transfer characteristics to the non-capped tubes. The utilization of either metal or plastic junctions for connecting the Tygon® and Teflon® tubes to the gas ion separator proved adequate for ion transfer with no noticeable difference in relative abundance being observed when one material was substituted for the other. In various embodiments of the invention, the inner diameter of the inlet tube of the gas ion separator can be increased as a means to match the potential for evacuating the sample region of the ionization source with an appropriate vacuum for the experiment, where the inside diameter of the inlet tube of the gas ion separator can be changed to optimize the volume of gas being sampled through the multiple inlet tubes. In an embodiment of the invention, the use of a transfer tube can reduce the amount of oxidation of a species after ionization when compared to the normal oxidation that might occur for a given analyte as it passes through even a short distance of atmosphere in transit to the spectroscopy system. In order to verify the integrity of the ions being analyzed the mass spectrum of an aliquot of Quinine was analyzed using a normal DART® ionization source positioned approximately 22.5 mm (1 inch) from the mass spectrometer inlet, the same DART® source positioned approximately 127 mm (5 inches) from the mass spectrometer inlet and finally, the same DART® source positioned approximately 1 m (40) inches from the mass spectrometer enabled with an ion transfer line composed of a approximately 1 m (40 inch), 6 mm (¼ inch) inside diameter Tygon® tube in combination with the gas ion separator. The normal DART® mass spectrum of Quinine FIG. 18A shows that very little oxidation product is produced in the conventional configuration where the ion at m/z 341 is only present at less than 2% abundance. As the distance between the ionization region and the inlet of the mass spectrometer increases by even a small distance, the ratio of the 341 Dalton to the 325 Dalton species increases to approximately 15% as shown in FIG. 18B thus demonstrating the negative effect of letting air interact with ions being produced in the ionization region and then drifting through the ambient atmosphere. In contrast, the transfer tube system was used to generate the mass spectrum of Quinine shown in FIG. 18C which contains less of the oxidized ion species. This is despite the fact that the ionized species have traveled through an approximately 1 m (40 inches) inlet tube along with an increased volume of oxygen derived from the ambient atmosphere.

Figure 19:
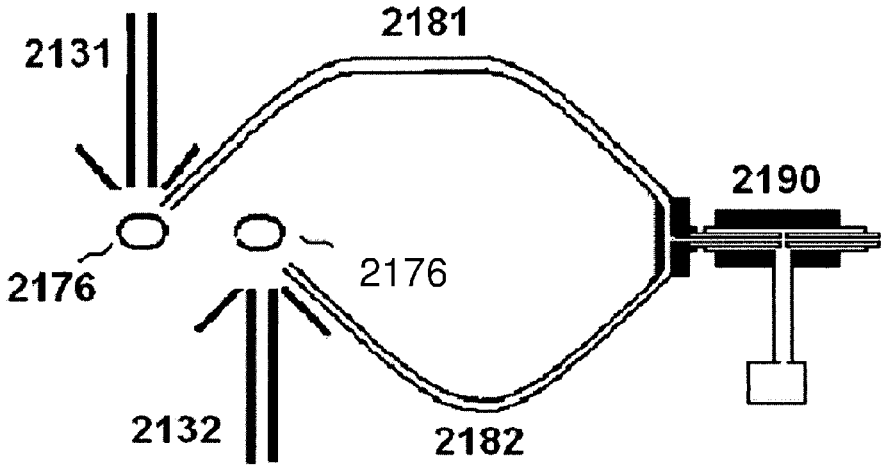
FIG. 19 shows a schematic diagram of an embodiment of a 'multiple desorption ionization source' where two DART® ionization sources are arranged in-line so that the sample can be introduced in between the two sources.

In an embodiment of the invention, a 'multiple desorption ionization source' included a plurality of DART® sources. In an embodiment of the invention, a linear actuator is configured to sequentially position a series of samples in front of multiple DART® sources as shown in FIG. 19. In this embodiment of the invention, an advantage of the invention is that each of the different desorption ionization sources does not require a separate mass spectrometer to analyze the ionized species. In an embodiment of the invention, the plurality of desorption ionization sources can be operated at different temperatures. In an alternative embodiment of the invention, the plurality of desorption ionization sources can be operated with different carrier gases. In various embodiments of the invention, one or more of the plurality of desorption ionization sources can be operated with one or more different methods of ionization the sample. In an embodiment of the invention, direct analysis real time desorption ionization source can be operated together with an atmospheric pressure chemical ionization source. In an embodiment of the invention, the plurality of desorption ionization sources can be operated where each ionization source has its own inlet tube for transfer of ions from the specific region of ionization for each source to the spectroscopy system. FIG. 19 shows the use of two desorption ionization sources (1931, 1932) configured in-line so that the linear actuator 1970 can be used to push a single sample or a series of samples through the ionization region associated 1976 for source 1931 and region 1977 for source 1932.

In an embodiment of the invention, a 'multiple desorption ionization source' included a plurality of inlet tubes to collect the stream of ions produced during the ionization process for analysis by one or more spectroscopy system. In samples containing a heterogeneous mixture of components collecting ions from a plurality of surfaces from the sample can reveal the heterogeneous nature of the mixture. Thus this embodiment of the invention also enables more efficient use of a spectroscopy system by carrying out multiple sample analyses from a single sample with a single spectroscopy system. An inlet tube 1981 for source 1931, is separate from the inlet tube 1982 for source 1932. Both inlet tubes (1981, 1982) are positioned to collect ions produced by each source (1931, 1932) independently. The multiple inlet tubes (1981, 1982) are subsequently merged at a union and the gas containing neutrals and ions passes into and through the gas ion separator 1990 for transfer to the spectroscopy system 1996 for analysis.

Figure 20A:
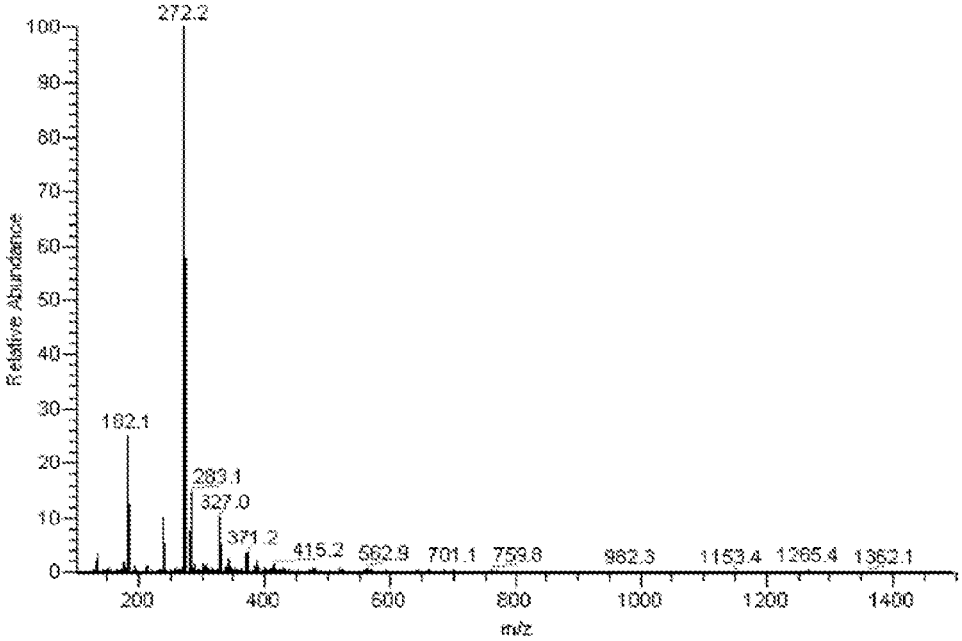
FIG. 20 shows the mass spectra of a sample of NyQuil® measured (A) with a single DART® source operated at low temperature of 100+/−5° C. where the predominant ions observed are derived from protonated active pharmaceutical ingredient, and (B) with a single DART® source operated at high temperature of 350+/−10° C. where a series of ions are observed produced by the polymeric excipient material present in the pharmaceutical formulation.
Figure 20B:
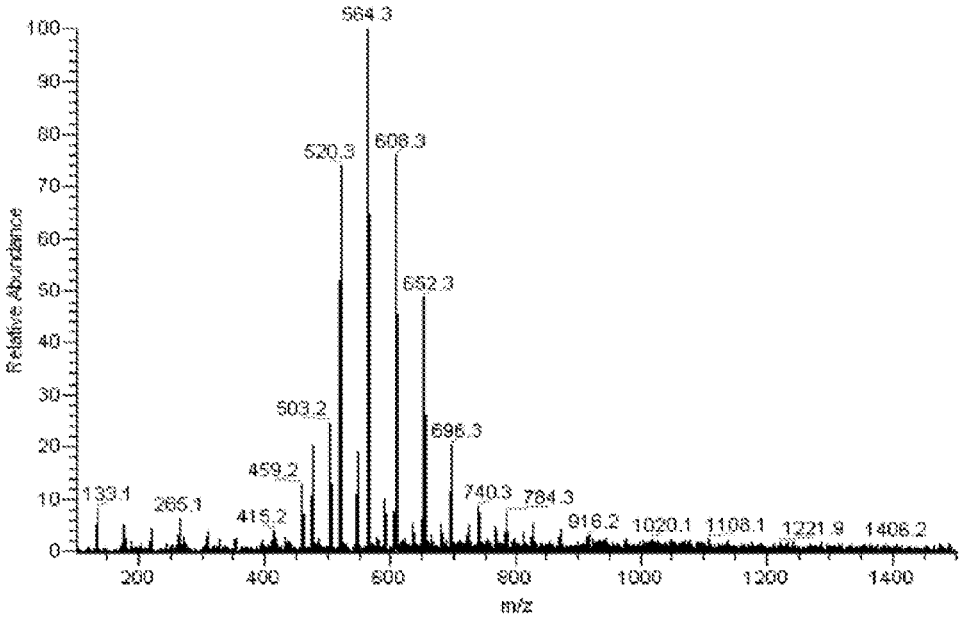

In the case of a complex sample such as a pharmaceutical product determining chemical properties such as purity, content, fragrance components, and color components can require multiple analyses. In an embodiment of the invention, a 'multiple desorption ionization source' includes a plurality of ionization sources and a plurality of inlet tubes which can be used to determine a variety of chemical properties in a near simultaneous time frame, using the apparatus shown in FIG. 19. Determination of the major chemical entities in a pharmaceutical product NyQuil® was completed by sequentially exposing a tablet containing the product to ionization by two ionization sources sequentially, one source operated at a relatively low temperature of 100+/−5° C., and a second source operated at a relatively high temperature of 350+/−10° C. in order to generate results that are specific for chemical composition of the tablet. The desorption products generated by using the low temperature source 1931 travel through the inlet tube 1981 into the gas ion separator and entering the spectroscopy system generating the mass spectrum shown in spectrum shown in FIG. 20A. Ions produced from desorption of the active pharmaceutical ingredient dominate the mass spectrum. As the linear actuator arm 1970 continues to push the same sample out of the desorption ionization region 1976 for the first source 1931 into the desorption ionization region for the second source 1932 which is operating at the higher temperature the mass spectrum shown in FIG. 20B was produced where the major ion series present are derived from the polymeric material that is used as an excipient in the pharmaceutical formulation. The ions produced by the second source travel into the spectroscopy system through the second inlet tube 1982. The utilization of the multiple sources utilizing a single spectroscopy system for detection of the desorption products enables higher throughput operations by permitting the single system to sample from many different sources.

Figure 21:
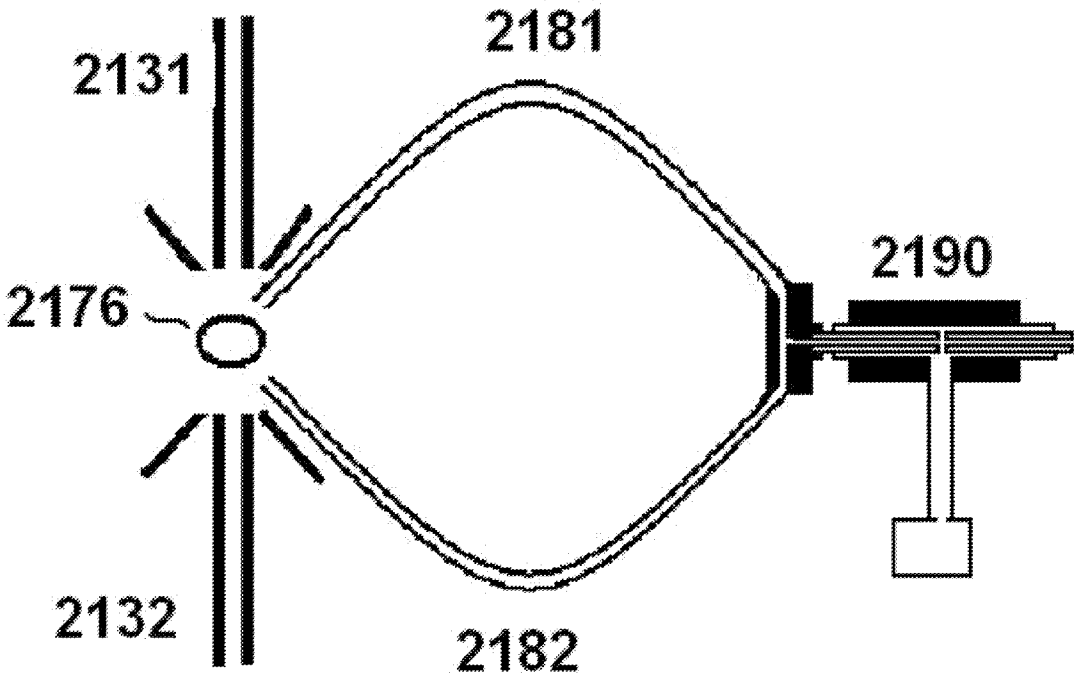
FIG. 21 shows a schematic diagram of an embodiment of a 'multiple desorption ionization source' where each source is positioned opposite one another to permit ionization of materials from opposite sides of an object. The configuration permits simultaneous determination of composition of a sample with a single spectroscopy system.

In an embodiment of the invention, two ionization sources 2131, 2132 are positioned opposite each other in a configuration where the sample is positioned in between the two sources in the ionization region 2176 (see FIG. 21). In this experiment configuration material desorbed from both sides of the sample are transferred to the spectroscopy system by the action of a vacuum pulling the desorption products through tubes 2181 and 2182. Additional tubes maybe positioned to collect desorption products from other regions around the desorption region 2176. The purpose of this configuration would be to more efficiently collect ions from the sample while using a single spectroscopy system.

Figure 22:
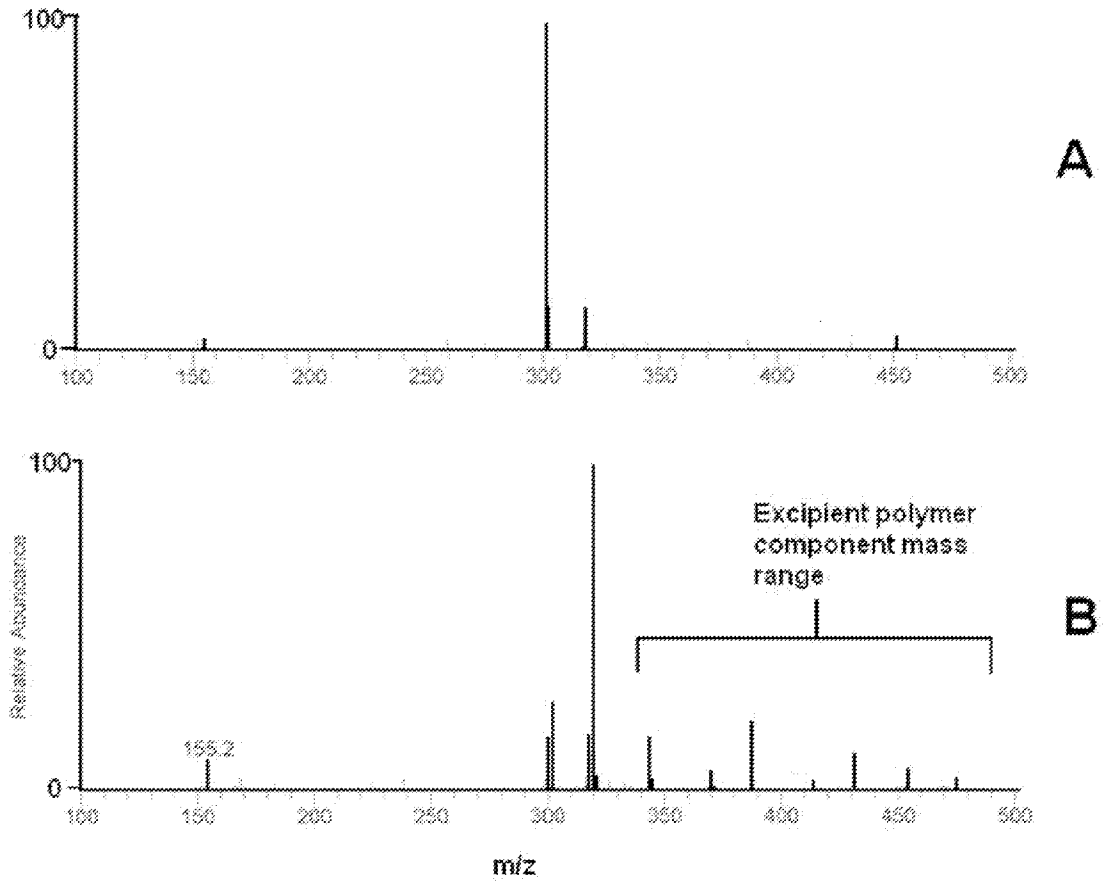
FIG. 22 shows the mass spectra generated using the experimental setup to ionize materials from a Tyenol® tablet positioned in the desorption ionization region 2176 between the two sources 2131, where in A the predominant on species produced is m/z 301 from the active pharmaceutical component and in B the second inlet tube 2182 was doped with ammonia vapor.

In an embodiment of a 'multiple desorption ionization source' each source has a sampling tube to permit transfer of ions and neutral molecules from the sample to the spectroscopy system for analysis where the conditions of each source can be different. In an embodiment of the invention, a 'multiple desorption ionization source' includes a volatile substance positioned inside of the inlet tube. In an embodiment of the invention, a 'multiple desorption ionization source' includes a non-volatile substance positioned inside of the inlet tube. In an embodiment of the invention, a 'multiple desorption ionization source' includes a source of volatile gas positioned inside of the inlet tube. In an embodiment of the invention, a 'multiple desorption ionization source' includes a dopant positioned inside the tube. In an embodiment of the invention, a volatile gas positioned inside of the inlet tube 2182 can be used to examine the potential for generating ion molecule reactions that would yield additional information about the composition of the sample. The desorption of ions in the presence of dopant gases has been described in the literature where the dopant gas is present in the ionization region 2176. In this embodiment we have removed the dopant gas from the desorption ionization region 2176 by placing it along the path that the ions and neutrals produced in the desorption ionization region must travel through the inlet tube 2182 in order to reach the spectroscopy system. The mass spectrum shown in FIG. 22 A was derived from the desorption ionization of a Tyenol® tablet positioned in the desorption ionization region 2176 between the two sources 2131 and 2132. In this mass spectrum the predominant ion specie produced is m/z 301 from the active pharmaceutical component. The mass spectrum shown in FIG. 22 B was derived from the same desorption conditions, however in this case the ions and neutrals desorbed traveled through the second inlet tube 2182 into which a swab previously dipped in ammonium hydroxide solution was placed to provide a source of ammonia vapor. The suction of the gas ion separator 2190 acts to draw the ions and neutrals into the tube 2182 where interaction with the ammonia vapor serves to generate a novel series of ions not present in the normal desorption ionization mass spectrum of the very same sample. The mass spectrum shown in FIG. 22 B contains a new series of ions derived from the polymer excipient materials present in the pharmaceutical product Tyenol®. Both sources were operated with the same desorption ionization conditions at 250+/−10° C. Helium carrier gas as the metastable carrier gas.

Experiments using other sources generating ions and neutrals necessary to provide additional information about a sample can also be carried out. However, by utilizing a plurality of ionization sources where each source does not require a separate spectroscopy system reduces the cost of the analysis system and the complexity of the experiment. While the complexity of the results can increase, this is offset by the ability to separately interrogate the sample at one or more of the specific conditions to deconvolute the spectra obtained. In an embodiment of the invention, a physical barrier can be introduced in one or more of the plurality of tubes in order to deconvolute the spectrum obtained from the simultaneous experiment. In an alternative embodiment of the invention, a potential can be applied in one or more of the plurality of tubes in order to deflect ions from traveling through the one or more tubes and thereby deconvolute the spectrum obtained from the simultaneous experiment. A considerable improvement in throughput could be achieved at minimal expense by using a single spectroscopy system to monitor the results of the experiment.

In an embodiment of the present invention, by utilizing a plurality of dopants introduced into one or more tube connecting a single ionization source with a single spectroscopy system, the nature of neutral molecules desorbed but not ionized from the sample can be ionized and thereby analyzed.

In an embodiment of the invention, the plurality of tubes can be connected to a spectrometer through a gas ion separator. In an alternative embodiment of the invention, the plurality of tubes can be directly connected to a spectrometer through appropriate couplings.

In an embodiment of the present invention, a device for analyzing a sample comprises: an ionization system including: an ionization source for forming analyte ions of the sample; a tube for transferring the analyte ions, wherein the tube has a proximal end and a distal end, wherein the proximal end of the tube is positioned relative to the sample such that analyte ions formed by the ionization source enter the proximal end of the tube; and a spectrometer connected with the one or more distal end of the tube such that analyte ions formed in the plurality of ionization systems enter the spectrometer. In an alternative embodiment of the present invention, a method of analyzing an analyte comprises: providing a device including a mass spectrometer, an atmospheric ionization source and a non-coaxial tube; generating analyte ions using the atmospheric ionization source; transferring analyte ions with the non-coaxial tube; and detecting the analyte ions.

Example embodiments of the methods, systems, and components of the present invention have been described herein. As noted elsewhere, these example embodiments have been described for illustrative purposes only, and are not limiting. Other embodiments are possible and are covered by the invention. Such embodiments will be apparent to persons skilled in the relevant art(s) based on the teachings contained herein. For example, it is envisaged that, irrespective of the actual shape depicted in the various Figures and embodiments described above, the outer diameter exit of the inlet tube can be tapered or non tapered and the outer diameter entrance of the outlet tube can be tapered or non tapered.

Thus, the breadth and scope of the present invention should not be limited by any of the above-described exemplary embodiments, but should be defined only in accordance with the following claims and their equivalents.

What is claimed is:

1. A device for analyzing an analyte comprising:

a plurality of ionization sources;

a plurality of flexible tubes, where each tube has a proximal end and a distal end, where the proximal end of the plurality of tubes is positioned at or near the analyte, where the distal end of the plurality of tubes combine into a single tube; and a spectrometer, where the single tube connects with the spectrometer.

2. The device of claim 1, where one or more of the plurality of ionization sources are operated at atmospheric pressure.

3. The device of claim 1, where one or more of the plurality of ionization sources are desorption ionization sources.

4. The device of claim 1, where one or more of the plurality of ionization sources is operated with a positive polarity, where one or more of the plurality of ionization sources is operated with a negative polarity.

5. The device of claim 1, further comprising one or more dopants introduced into one or more of the plurality of tubes.

6. The device of claim 1, where one or more of the plurality of ionization sources are selected from the group consisting of a Direct Ionization in Real Time source, a desorption electrospray ionization (DESI) source, an atmospheric laser desorption ionization source, a Corona discharge source, an inductively coupled plasma (ICP) source and a glow discharge source.

7. The device of claim 1, where one or more of the plurality of ionization sources is operated with a first reagent gas, where one or more of the plurality of ionization sources is operated with a second reagent gas, where the first reagent gas is not the same as the second reagent gas.

8. The device of claim 1, where one or more of the plurality of ionization sources is operated at a first temperature and one or more of the plurality of ionization sources is operated at a second temperature, where there is a difference between the first temperature and the second temperature.

9. The device of claim 8, where the difference is between:

a lower limit of approximately 5° C.; and an upper limit of approximately $5\times10^{2\circ}$ C.

10. A method of analyzing an analyte comprising the steps of:

providing the device of claim 1;

orientating the plurality of ionization sources relative to the analyte to generate analyte ions;

orienting the plurality of tubes relative to one or both the analyte and the plurality of ionization sources to direct analyte ions into the proximal end of one or more of the plurality of tubes;

transferring the analyte ions through the single tube into the spectrometer; and analyzing the analyte ions with the spectrometer.

11. The method of claim 10, where one or more of the plurality of ionization sources is selected from the group consisting of a Direct Ionization in Real Time source, a desorption electrospray ionization (DESI) source, an atmospheric laser desorption ionization source, a Corona discharge source, an inductively coupled plasma (ICP) source and a glow discharge source.

12. The method of claim 10, where one or more of the plurality of ionization sources is operated with a first reagent gas, where one or more of the plurality of ionization sources is operated with a second reagent gas, where the first reagent gas is not the same as the second reagent gas.

13. The method of claim 10, where one or more of the plurality of ionization sources is operated with a positive polarity, where one or more of the plurality of ionization sources is operated with a negative polarity.

14. The method of claim 10, where one or more dopants is introduced into one or more of the tubes.

15. The method of claim 10, where one or more of the plurality of ionization sources is operated at a first temperature and one or more of the plurality of ionization sources is operated at a second temperature, where there is a difference between the first temperature and the second temperature.

16. The method of claim 15, where the difference is between:

a lower limit of approximately 5° C.; and an upper limit of approximately $5\times10^{2\circ}$ C.

17. A system of analyzing an analyte comprising:

(a) a sample holder;

(b) a spectrometer;

(c) a plurality of ionization sources; and (d) a plurality of flexible tubes positioned at or near the sample holder, where each tube has a proximal end and a distal end, where the proximal end of the plurality of tubes is positioned at or near the analyte, where the distal end of the plurality of tubes combine into a single tube which enters the spectrometer.

18. The system of claim 17, where one or more of the plurality of ionization sources is operated with a first method of ionization, where one or more of the plurality of ionization sources is operated with a second method of ionization.

19. A method of analyzing an analyte comprising the steps of:

providing the system of claim 17;

positioning the analyte on the sample holder;

orientating the plurality of ionization sources relative to the analyte to generate analyte ions;

orienting the plurality of tubes relative to one or both the analyte and the plurality of ionization sources to direct analyte ions into the proximal end of one or more of the plurality of tubes;

transferring the analyte ions through the single tube into the spectrometer; and analyzing the analyte ions with the spectrometer.

* * * * *